US009743187B2

(12) United States Patent
Bender

(10) Patent No.: US 9,743,187 B2
(45) Date of Patent: Aug. 22, 2017

(54) DIGITAL AUDIO PROCESSING SYSTEMS AND METHODS

(71) Applicant: Lee F. Bender, Hunstville, AL (US)

(72) Inventor: Lee F. Bender, Hunstville, AL (US)

(73) Assignee: Lee F. Bender, Huntsville, AL (US)

( * ) Notice: Subject to any disclaimer, the term of this patent is extended or adjusted under 35 U.S.C. 154(b) by 109 days.

(21) Appl. No.: 14/975,322

(22) Filed: Dec. 18, 2015

(65) Prior Publication Data

US 2016/0183003 A1 Jun. 23, 2016

Related U.S. Application Data

(60) Provisional application No. 62/094,528, filed on Dec. 19, 2014, provisional application No. 62/253,483, filed on Nov. 10, 2015.

(51) Int. Cl.

| | |
|---|---|
| ***H04R 5/02*** | (2006.01) |
| ***H04R 5/033*** | (2006.01) |
| ***H04S 1/00*** | (2006.01) |

(52) U.S. Cl.

CPC ..... *H04R 5/033* (2013.01); *H04S 1/007* (2013.01); *H04S 2400/13* (2013.01)

(58) Field of Classification Search

CPC ..... H04S 2400/13; H04S 1/007; H04R 5/033
See application file for complete search history.

(56) References Cited

U.S. PATENT DOCUMENTS 7,065,218 B2 * 6/2006 Schobben ..... H04S 3/00 381/10
2006/0083394 A1 * 4/2006 McGrath ..... H04S 3/00 381/309

(Continued)

*Primary Examiner* — Regina N Holder
(74) *Attorney, Agent, or Firm* — Ann I. Dennen; Lanier Ford Shaver & Payne PC

(57) ABSTRACT

A system for processing audio data of the present disclosure has an audio processing device for receiving audio data from an audio source. Additionally, the system has logic that separates the audio data received into left channel audio data indicative of sound from a left audio source and right channel audio data indicative of sound from a right audio source. The logic further separates the left channel audio data into primary left ear audio data and opposing right ear audio data and for separating the right channel audio data into primary right ear audio data and opposing left ear audio data applies a first filter to the primary left ear audio data, a second filer to the opposing right ear audio data, a third filter to the opposing left ear audio data, and a fourth filter to the primary right ear audio data, wherein the second and third filters introduce a delay into the opposing right ear audio data and the opposing left ear audio data, respectively. Also, the logic sums the filtered primary left ear audio data with the filtered opposing left ear audio data to obtain processed left channel audio data and sums the filtered primary right ear audio data with the filtered opposing right ear audio data to obtain processed right channel audio data. The logic further combines the processed left channel audio data and the processed right channel audio data into processed audio data and outputting the processed audio data to a listening device for playback by a listener.

18 Claims, 17 Drawing Sheets

(56) References Cited

U.S. PATENT DOCUMENTS

2012/0039477 A1* 2/2012 Schijers ..... G10L 19/008
381/22
2012/0213375 A1* 8/2012 Mahabub ..... H04S 5/00
381/17
2014/0355765 A1* 12/2014 Kulavik ..... H04S 7/302
381/17

* cited by examiner

DIGITAL AUDIO PROCESSING SYSTEMS AND METHODS

CROSS REFERENCE TO RELATED APPLICATION

This application claims priority to U.S. Provisional Patent Application Ser. No. 62/094,528 entitled Binaural Conversion Systems and Methods and filed on Dec. 19, 2014 and U.S. Provisional Patent Application Ser. No. 62/253,483 entitled Binaural Conversion Systems and Methods and filed on Nov. 10, 2015, both of which are incorporated herein by reference in its entirety.

BACKGROUND

An original recording of music is typically mastered for delivery to a two-channel audio system. In particular, the original recording is mastered such that the sound reproduction on a typical stereo system having two audio channels creates a specific auditory sensation. In a typical audio system, there are two audio channel sources, or speakers, and the original recording is mastered for playback in such a configuration.

It has become very popular for individuals to listen to music using ear-based monitors, such as headphones, earphones, or earbuds. Unfortunately, because the original recordings are mastered for the two audio channel sources, assuming that the listener will be observing sound by both ears from both channels, the playback of music on ear-based monitors does not provide a proper listening experience as intended by the artist. This is because the manner in which the original recording was made was intended to be observed by both of the listener's ears simultaneously. This externalization of the sound source allows the listener's brain to identify the different sound source locations on a horizontal plane, and to a lesser extent it allows the listener's brain to identify depth.

There are two key issues that are present when using ear-based monitors. Both the physical delivery of the music (or sound data stream) to the listener and the physical capabilities of the drivers delivering the sound to the listener's ears each have limitations. The limitations have prevented individuals from experiencing the best possible sound as originally constructed in the studio. Notably, when using ear-based monitors, the physical delivery to the listener's ears isolates each of the two different audio tracks into specific left and right channels. This isolation prohibits the brain from processing the sound information in the manner in which it was originally mastered. This results in the internalization of the sound, which places the perception of all the sound information directly between the listener's ears.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 15 1 is a block diagram illustrating a listening configuration to generate ear filters for a voice chat or teleconferencing scenario.

DETAILED DESCRIPTION

Embodiments of the present disclosure generally pertain to systems and methods for re-processing audio stream information or audio files for use with headphones, earphones, earbuds, near field small speakers or any ear-based monitor. Additionally, embodiments of the present disclosure pertain to systems and methods for processing voice data streams from a chat session or audio voice conference.

Figure 1:
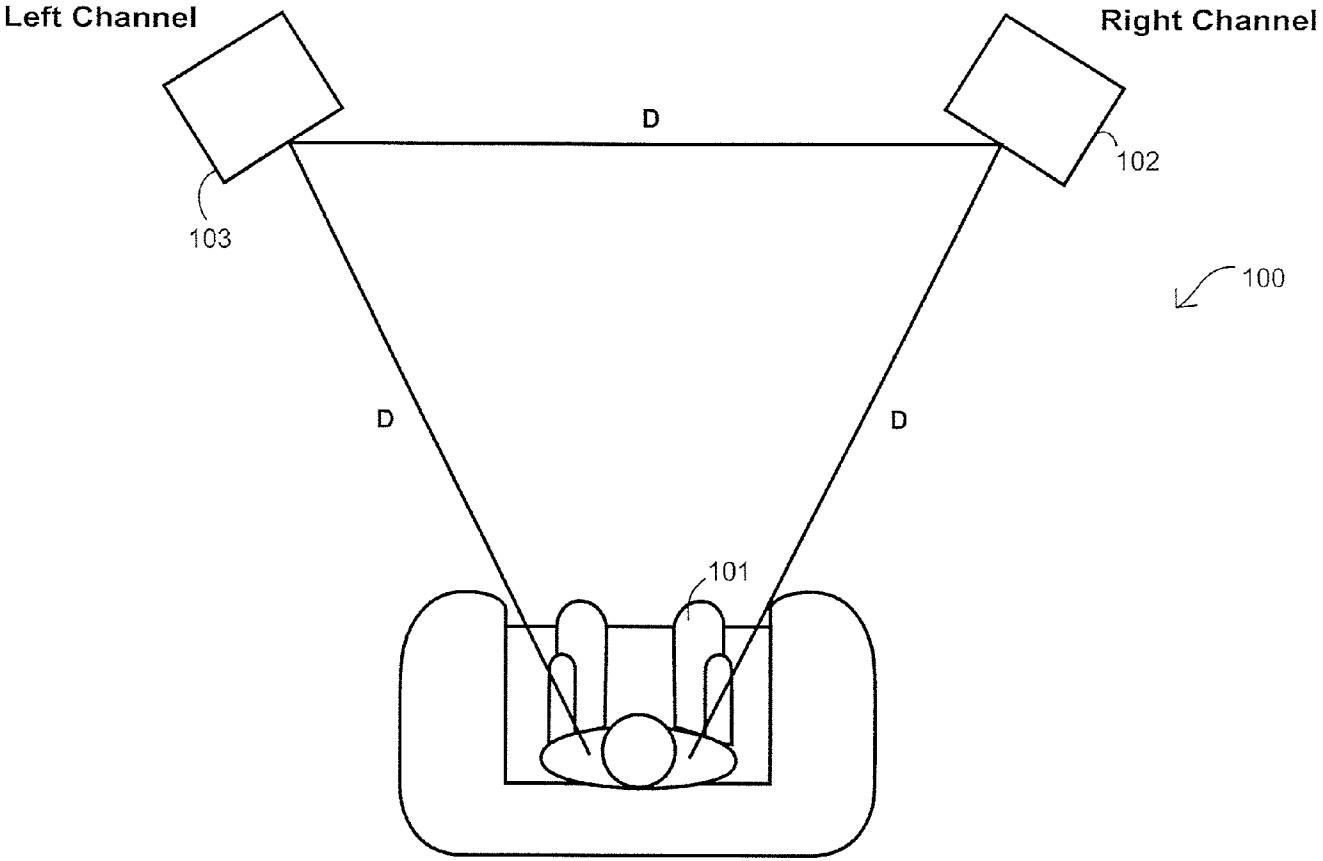
FIG. 1 is a block diagram illustrating a listening configuration utilized in a traditional two channel stereo system.

FIG. 1 depicts a listening configuration and alignment 100 utilized for the enjoyment of stereo audio content in a traditional two channel stereo system. In the present example, the two channel stereo system refers to the delivery of audio via two channel sources 102, 103.

In the configuration, the listener 101 is shown within a triangular shaped alignment with the two audio channel sources 102, 103. Note that the audio channel sources 102, 103 may be, for example, a set of speakers. The listener 101, the audio channel source 102, and the audio channel source 103 are an equal distance "D" apart. In the configuration depicted, the front center (drivers) of each respective audio channel source 102, 103 is either aimed inward at a 30 degree angle to deliver the sound from each audio channel sources 102, 103 directly to each of the listener's closest ear, or they may be pointed (at a reduced angle) to direct the sound just behind the head of the listener 101, based upon personal preference.

Figure 2:
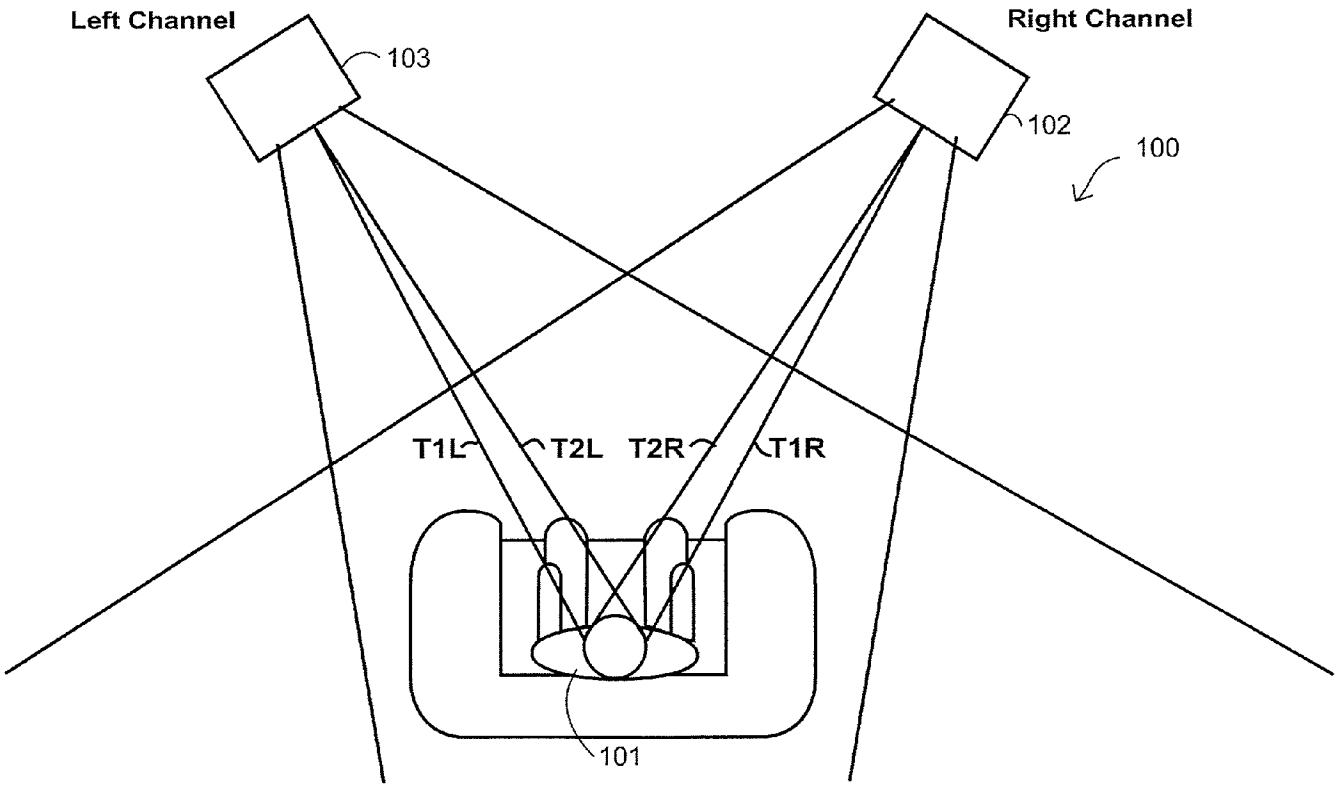
FIG. 2 is a block diagram illustrating the configuration of FIG. 1 and showing the sound waves emitting from two audio sources.

FIG. 2 is the configuration 100 shown in FIG. 1 further depicting how the sound waves are dispersed to the listener in the proper stereo listening configuration 100. As will be described, the user's left ear (not shown) receives sound from both the audio channel sources 102 and 103, and the user's right ear (not shown) receives sound from both the audio channel sources 102 and 103.

Figure 3:
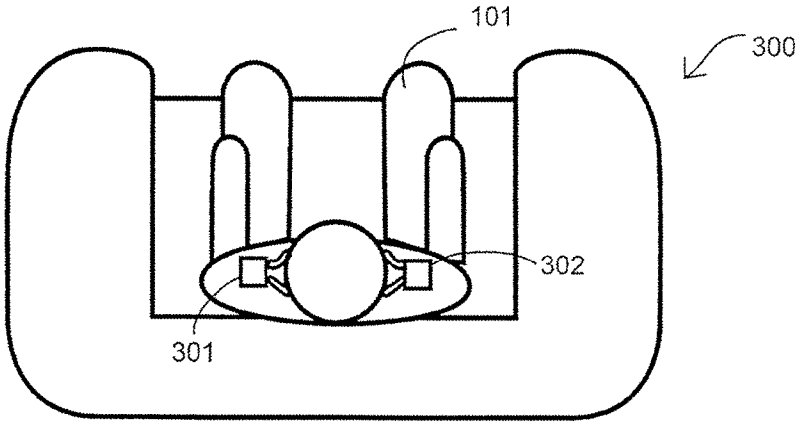
FIG. 3 is a block diagram illustrating a listening configuration utilized when listening to ear-based monitors.

In such a configuration 100, two concepts are notable, which do not exist when using headphones, earphones, earbuds or any ear based monitors, which is described herein with reference to FIG. 3. In this regard, each ear of the listener 101 is observing sound from the opposing audio channel source as well as the primary audio channel source, i.e., the left ear is observing sound from the audio channel source 102, and the right ear is observing sound from the audio channel source 103. Although the opposing ear is not directly facing towards the sound audio channel source, it is still receiving sound from both the audio channel sources 102, 103, simultaneously. In addition, the sound that is being observed by each opposing ear is received at a different decibel level (frequency dependent) and arrives at a very slight delay as compared to when it reaches each of the primary (closest) ears. Note that the "primary ear" in reference to the channel source 103 is the listener's left ear, and the opposing ear in reference to the channel source 103 is the listener's right ear. Likewise, the "primary ear" in reference to channel source 102 is the listener's right ear, and the opposing ear in reference to the channel source 102 is the listener's left ear. Note that the term "primary channel" refers to audio channel source 103 when referencing the left ear, and the "primary channel" refers to audio channel source 102 when referencing the right ear.

The exact duration of the delay that is experienced is determined by subtracting the difference in the time that it takes for sound to reach the closest ear from the time required to reach the opposing ear. In this regard, the right ear delay for the channel source 103 is T2L−T1L, and the left ear delay for the channel source 102 is T2R−T1R, were T is equal to the time in millisecond for the distance traveled by the sound waves. Note that when stereo content is listened to with an ear-based monitor such as headphones, earphones or earbuds, which is described with reference to FIG. 3, each ear is only exposed to sound coming from the primary channel for that respective ear and no audio delays are present.

Notably, the ability for each of the listener's ears to hear specific sounds coming from both the left and right audio channel sources 102, 103 combined with this small delay allows for a virtual "soundstage" to be assembled within the listener's brain. Vocals, instruments and other various sounds may be observed in the horizontal plane to appear within varying locations between, and sometimes outside of, the physical audio channel source locations. Such localization is not possible when playing traditional stereo content through any ear based monitors, as no delay exists and each ear is only exposed to the sound information coming from one specific primary audio channel, as is depicted in FIG. 3.

When the listener's ears receive sound information from both audio channel sources 102, 103 in a proper stereo arrangement, a number of physical characteristics alter the sound before it reaches the ear canal. Physical objects, walls, floors and even human physiology factor in to create reflections, distortions and echoes which will alter how the sound is perceived by the brain. The various individual electronic components used in the playback of audio content will also alter the tonal characteristics of the music, which will also affect the quality of the listening experience.

FIG. 3 depicts a configuration 300 for use of ear-based monitors to listen to music. In the configuration, the listener 101 wears audio channel sources 301 and 302, which can be ear-based monitors, including headphones, earphones, or earbuds. Notably, each ear is only exposed to sound coming from the primary channel for that respective ear, and no audio delays are present when compared to a conventional stereo listening configuration 100 (FIGS. 1 & 2).

Figure 4:
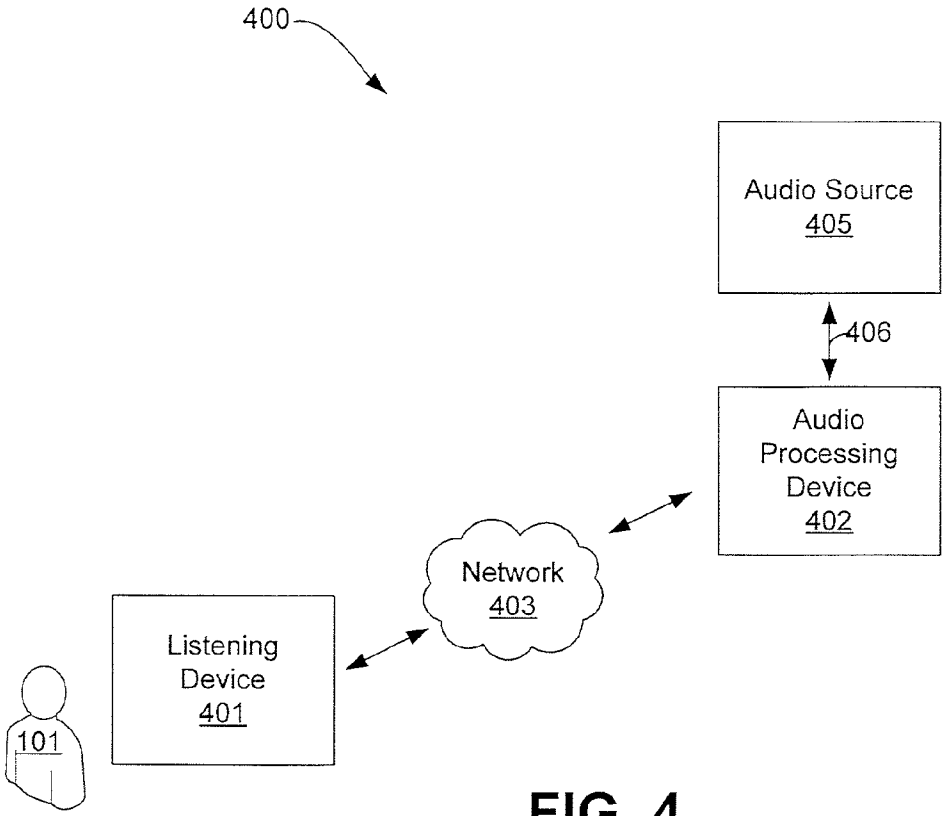
FIG. 4 is a block diagram of an exemplary audio processing system in accordance with an embodiment of the present disclosure.

FIG. 4 is a block diagram of an audio processing system 400 in accordance with an embodiment of the present disclosure. The system 400 comprises an audio data source 405, an audio processing device 402, and a listening device 401. The listener 101 listens to music, or other audio data, via the listening device 401.

The audio source 405 may be any type of device that creates or otherwise generates, stores, and transmits audio data. Audio data may include, but is not limited to stream data, Moving Picture Experts Group Layer-3 Audio (MP3) data, Windows Wave (WAV) data, or the like. In some instances, the audio data is data indicative of an original recording, for example, a recording of music. In regards to streaming data, the audio data may be data indicative of a voice chat, for example.

In operation, audio data, or streaming audio, are downloaded via a communication link 406 to the audio processing device 402. The audio processing device 402 processes the files, which is described further herein, and downloads data indicative of the processed files to a listener's listening device 401 via a network 403. The network 403 may be a public switched telephone network (PSTN), a cellular network, or the Internet. The listener 101 may then listen to music indicative of the processed file via the listening device 401.

Note that the listening device 401 may include any type of device on which processed audio data can be stored and played. The listening device 401 further comprises headphones, earphones, earbuds, or the like, that the user may wear to listen to sound indicative of the processed audio data.

Figure 5:
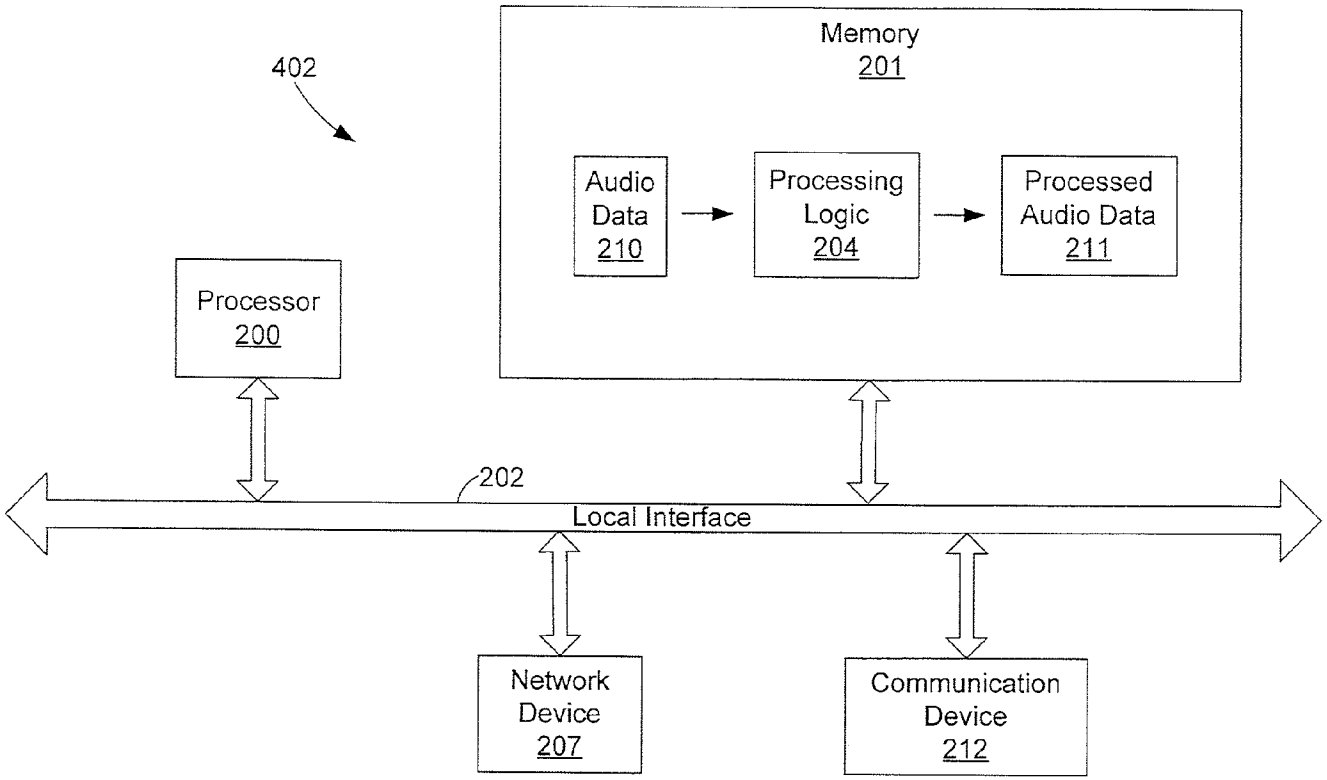
FIG. 5 is a block diagram of an exemplary audio processing device as depicted in FIG. 4.

FIG. 5 depicts an exemplary embodiment of the audio processing device 402 of FIG. 4. The device 402 comprises at least one conventional processing element 200, such as a central processing unit (CPU) or digital signal processor (DSP), which communicates to and drives the other elements within the device 402 via a local interface 202.

The computing device 402 further comprises processing logic 204 stored in memory 201 of the device 402. Note that memory 201 may be random access memory (RAM), read-only memory (ROM), flash memory, and/or any other types of volatile and nonvolatile computer memory. The processing logic 204 is configured to receive audio data 210 from the audio data source 405 (FIG. 4) via a communication device 212 and store the audio data 210 in memory 201. The audio data 210 may be any type of audio data, including, but not limited to MP3 data, WAV data, or streaming data.

Note that the processing logic 204 may be software, hardware, or any combination thereof. When implemented in software, the processing logic 204 can be stored and transported on any computer-readable medium for use by or in connection with an instruction execution apparatus that can fetch and execute instructions. In the context of this document, a "computer-readable medium" can be any means that can contain or store a computer program for use by or in connection with an instruction execution apparatus.

Once the audio data 210 has been received and stored in memory 201, the processing logic 204 translates the received audio data 210 into processed audio data 211. The processing logic 204 processes the audio data 210 in order to generate audio data 211 that sounds like the original recording with a more realistic sound when listened to by headphones, earphones, earbuds, or the like.

In processing the audio data 210, the processing logic 204 initially separates the audio data 210 into data indicative of a left channel and data indicative of a right channel. That is, the data indicative of the left channel is data indicative of the sound heard by the listener's ears from the left channel, and data indicative of the right channel is data indicative of the sound heard by the listener's ears from the right channel.

Once the audio data 210 is separated, the processing logic 204 separates and then processes the left channel audio data into primary left ear audio data and opposing right ear audio data via a filtering process, which is described further herein. Notably, the left channel primary left ear audio data comprises data indicative of the sound heard by the left ear from the left channel. Further, the left channel opposing right ear audio data comprises data indicative of the sound heard by the right ear from the left channel, as is shown in FIG. 2.

The processing logic 204 also separates and then processes the right channel audio data into primary right ear audio data and opposing left ear audio data via a filtering process, which is described further herein. Notably, the right channel primary right ear audio data comprises data indicative of the sound heard by the right ear from the right channel. Further, the right channel opposing left ear audio data comprises data indicative of the sound heard by the left ear from the right channel, as is shown in FIG. 2.

Once the audio data is filtered as described, the processing logic 204 sums the filtered primary left ear audio data with the opposing right ear audio data, which is obtained from the right channel and is delayed via the filtering process. This sum is hereinafter referred to as the left channel audio data. In addition, the processing logic 204 sums the primary right ear audio data and the opposing left ear audio data, which is obtained from the left channel and is delayed via the filtering process. This sum is hereinafter referred to as the right channel audio data.

The processing logic 204 equalizes the left channel audio data and the right channel audio data. This equalization process, which is described further herein, may be a flat frequency response and/or hardware specific, i.e., equalization to the left and right channel audio data based upon the hardware to be used by the listener 101 (FIG. 2).

The processing logic 204 then normalizes the recording level of the left channel audio data and the right channel audio data. During normalization, the processing logic 204 performs operations that ensure that the maximum decibel (Db) recording level does not exceed the 0 Db limit. This normalization process is described further herein.

The processing logic 204 then combines the left channel audio data and the right channel audio data and outputs a combined file in WAV format, which is the processed audio data 211. In one embodiment and depending upon the user's desires, the processing logic 204 may further re-encode the WAV file into the original format or another desired format. The processing logic 204 may then transmit the processed audio data 211 to a listening device 401 (FIG. 4) via a network device 207 that is communicatively coupled to the network 403 (FIG. 4).

Note that during operation, the processing logic 204 re-assembles the sound of the original recording that is observed within a proper listening configuration, such as is depicted in FIG. 2, specifically for playback when using ear-based monitors 301, 302 (FIG. 3), without any of the undesired negative effects that may be introduced by any external factors. The processed logic 204 provides the listener 101 (FIG. 3) with processed audio data 211 that greatly enhances the listening experience, without altering the tonal characteristics or integrity of the original performance, except when hardware specific profiles are used.

Further, the processing logic 204 isolates all of the factors that distinguish the proper listening arrangement 100 (FIG. 1) for stereo content from what is normally observed with ear-based monitors 301, 302. By applying these characteristics to the audio data 210 before they are decoded for playback as an analog output, the processing logic 204 is able to re-processes audio data 210 so that the listener 101 (FIG. 3) experiences the spatial sound of the configuration 100 (FIG. 2) when using ear-based monitors 301, 302, without negatively altering or changing the sound quality of the original recording. The sounds delivered to each ear will be directly comparable to sounds experienced when listening to properly set up external audio channel sources 102, 103 (FIG. 1), assuming that the audio channel sources 102, 103 are capable of faithfully and accurately reproducing the music as it was originally recorded. This means that the only variable that can adversely affect the quality of the playback is the accuracy and capability of the ear-based monitors being utilized by the listener.

Note that in one embodiment, as indicated hereinabove, the audio data 210 may be data indicative of voice communications between multiple parties, e.g., streamed data. In such an embodiment, the processing logic 204 creates specific filters for each individual participant in the conversation, and the processing logic 204 places each person's voice in a different perceived location within the processed audio data 211. When the processed audio data 211 is played to a listener, the listener's brain is able to isolate each individual voice (or sound) present within the processed audio data 211, which allows them to prioritize a specific voice among the group. This is not unlike what happens when having a live conversation with someone in a noisy environment or at an event where many people are present. The localization cues that are applied during by the processing logic 204 will allow an individual to carry out a conversation with multiple parties. Without this process, the brain would not be able to discern multiple voices speaking simultaneously. This process is further described with reference to FIGS. 13-17.

To further note, the processing logic 204 addresses shortcomings that may be present in the specific hardware, e.g., headphones, earbuds, or earphones, that is reproducing the processed audio data 211 delivered to the listener. The vast majority of all headphones, earphones and earbuds use only one (speaker) driver to deliver the sound information to each respective ear. It is impossible for this individual driver to accurately reproduce sounds across the entire audible spectrum. Although many devices are tuned to enhance the low frequency reproduction of bass signals, most all ear based monitors are incapable of faithful reproduction of higher frequencies.

In this regard, the processing logic 204 uses actual measured frequency response data generated from the testing of a specific individual set of headphones, earphones, earbuds, or small near field speakers and applies a correction factor during equalization of the audio data 210 to compensate for the tonal deficiencies that are inherent to the hardware. The combination of the primary process with this equalization correction applied will ensure the best possible listening experience for the particular hardware that each individual is utilizing. Not only will the newly created audio file deliver a similar auditory experience to when the recording was originally mixed in the studio or by utilizing a properly set up and exceptionally accurate stereo system, but it will also deliver a more tonally authentic reproduction of the original recording. This is due to the fact that the processing logic 204 specifically optimizes for the individual playback hardware being used by the listener. In the case of communications with multiple voice inputs, this equalization process may not be necessary, because voice data falls within a frequency range that is accurately reproduced by most all ear based monitors.

Figure 6:
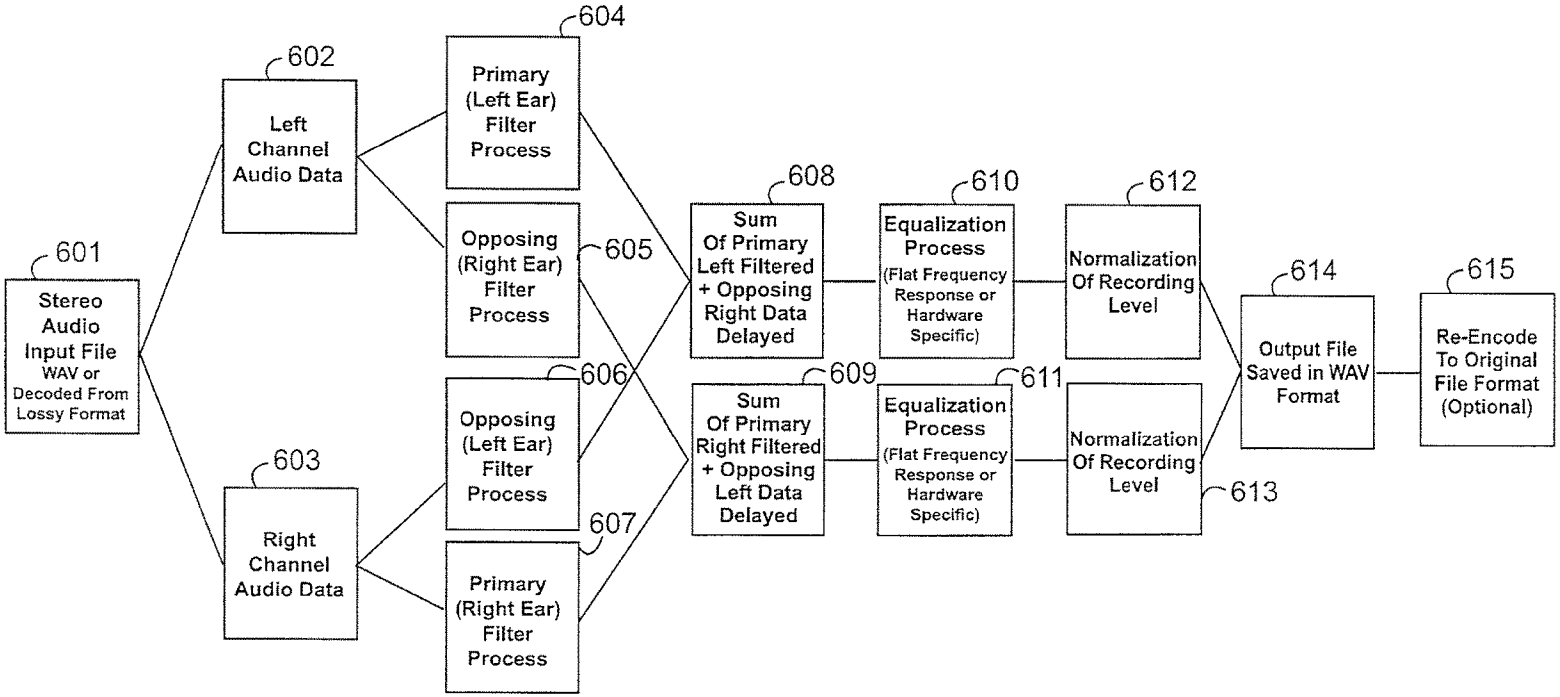
FIG. 6 is a flowchart illustrating exemplary architecture and functionality of exemplary processing logic as depicted in FIG. 5.

FIG. 6 is a block diagram depicting exemplary architecture and functionality of the processing logic 204 (FIG. 4). Generally, the processing logic receives audio data 210 from an audio data source and translates the audio data 210 into the processed audio data 211.

In block 601, the processing logic 204 receives the audio data 210, which can be, for example, a data stream, an MP3 file, a WAV file, or any type of data decoded from a lossless format. Note that in one embodiment, if the audio data 210 received by the processing logic 204 is a compressed format, e.g., MP3, AIFF, AAC, M4A, or M4P, the processing logic 204 first expands the received audio data 210 into a standard WAV format. Depending upon the compression scheme and the original audio data 210 prior to compression, the expanded WAV file may use a 16-bit depth and a sampling frequency of 44,110 Hertz. This is the compact disc (CD) audio standard, also referred to as "Red Book Audio." In one embodiment, the processing logic 204 processes higher resolution uncompressed formats in their native sampling frequency with a floating bit depth of up to 32 bits. Note that in one embodiment, a batch of audio data 210, wherein the audio data 210 comprises data indicative of a plurality of MP3 files, WAV files or other types of data may be queued for processing, and each MP3 file and WAV file is processed separately by the processing logic 204.

Once a compatible stereo WAV file or data stream has been generated by the processing logic 204, the processing logic separates the audio data 210 into primary left channel audio data and primary right channel audio data, as indicated by blocks 602 and 603, and the processing logic 204 processes the left channel and right channel audio data individually. The left channel audio data indicative of sound from a left audio source, and the right channel audio data indicative of sound from a right audio source.

The processing logic 204 processes the left channel audio data and the right channel audio data through two separate filters to create both primary audio data and opposing audio data for each of the left channel audio data and right channel audio data. The data indicative of the primary and opposing audio data for each of the left channel audio data and right channel audio data are filtered, as indicated by blocks 604 through 607. The processing logic 204 re-assembles these four channels with a slight delay applied to the opposing audio data. This will provide the same auditory experience when using ear based monitors as what is observed with a properly set up stereo arrangement 100 (FIG. 1) within an ideal environment.

Notably, audio data associated with the left channel is the left ear primary audio data (primary audio heard by a listener's left ear) and the right ear opposing audio data (opposing audio heard by a listener's right ear). The processing logic 204 applies a filter process to the left channel primary audio data, which corresponds to the left ear of a listener, as indicated in block 604, and the processing logic 204 applies a filter process to the left channel right ear opposing audio data, which corresponds to the right ear of a listener, as indicated in block 605.

Further note, audio data associated with the right channel is the right ear primary audio data (primary audio heard by the listener's right ear) and the left ear opposing audio data (opposing audio heard by a listener's left ear). The processing logic 204 applies a filter process to the right channel primary audio data, which corresponds to the right ear of a listener, as indicated in block 607, and the processing logic 204 applies a filter process to the right channel left ear opposing audio data, which corresponds to the left ear of a listener, as indicated in block 606.

Each of these filters applied by the processing logic 204 is pre-generated, which is now described. The filters applied by the processing logic 204 are pre-generated by creating a set of specialized recordings using highly accurate and calibrated omnidirectional microphones. A binaural dummy head system is used to pre-generate the filters to be applied by the processing logic 204. The omnidirectional microphones are placed within a simulated bust that approximates the size, shape and dimension of the human ears, head, and shoulders. Audio recordings are made by the microphones, and the resulting recordings exhibit the same characteristics that are observed by the human physiology in the same physical configuration.

The shape of the ear and presence of the simulated head and shoulders, combined with the direction and spacing of the microphones from each other create recordings that introduce the same directional cues and frequency recording level shifts that are observed by a human while listening to live sounds within the environment. There are several factors that may be quantified through the analysis of these recordings. These include the inter-aural delays from the opposing channel, the decibel per frequency offset ("ear filters") for each near and opposing ear and any environmental echoes which may be observed. Each of these individual characteristics introduces specific changes to the perception of sound within these recordings when listening to them using ear based monitors. To accurately quantify each of these characteristics, specialized recordings of white noise, pink noise, frequency sweeps, short specific frequency chirps and musical content are all utilized.

To accurately define the "ear filters" that must be applied to each of the primary left ear data, opposing right ear data, primary right ear data, and opposing left ear data, the pre-generation isolates the characteristics that distinguish the original sound source from what is observed by the binaural recording device. If the original digital sound source is directly compared with the binaurally recorded version of the same audio file, the filter generated would not provide valid data. This is because all of the equipment in the pre-generation system, from the playback devices, the recording hardware and the accuracy of the microphones would all introduce undesirable alterations to the original source file. It would be improper to generate filters in this manner, as unwanted characteristics from the hardware within this playback and recording chain would then become part of the filtering process, and this would result in alterations to the sound of the recording.

In order to isolate just the differences that exist between the original recording and how the sound is observed by the binaural "dummy head" recording device, two different sets of recordings are created from the original test files. The first recording is a "free field" recording of the original source material, where the same playback hardware, recording devices and microphones are used to create a baseline. This is accomplished by recording all of the noise tests, sweeps, tones, chirps and musical content with both microphones floating in a side by side "free field" arrangement pointing directly towards the sound source at the same position, volume level and distance as the recordings that are created using the binaural microphone system.

The binaural recordings of the same source material are then compared with the baseline recording in order to isolate all of the characteristics which are introduced by the physical use of the binaural recording device only. Since all of the same equipment is being utilized during both recordings, they cannot introduce any undesired external influence on the filters that are generated by comparing the two recordings with each other. This also eliminates the negative effects of any differences that may exist between the recording microphones and their accuracy, as each of the two channels are only being compared with data being created by the exact same microphone.

During these test recordings, each primary channel is recorded separately. This ensures that there is no interference in isolating the opposing channel filter information. It also allows for the accurate measurement of the inter-aural delay that exists when sounds reach each opposing ear in comparison to the primary (closest) recording ear.

Figure 7:
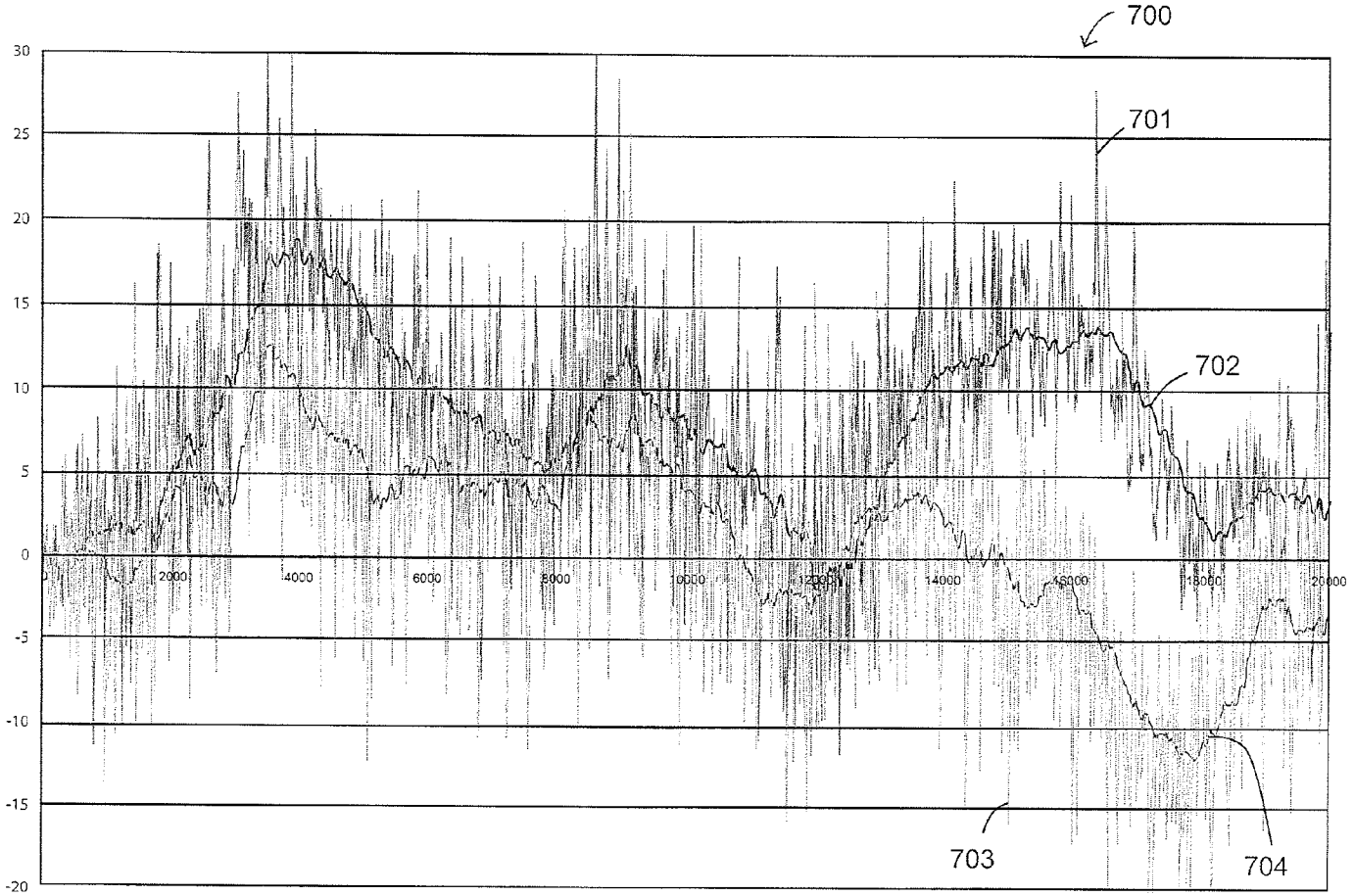
FIG. 7 is a graph showing exemplary filters in accordance with an embodiment of the present disclosure.

A graphical depiction of the filter data that is generated using this method is depicted in FIG. 7. FIG. 7 shows a graph 700, which is the actual frequency response (decibel level) changes across the entire audible range for both the primary and opposing ear microphones during the recording of white noise, when compared to a recording of the same audio file with the microphones utilized in a free field configuration. The graph 700 is generated of a left channel sound source only, and the primary ear results are indicated by line 701, while the opposing ear results are indicated by line 703. Note that line 702 is a running average of the data indicative of line 701, and line 704 is a running average of the data indicative of line 703. It is these recording level shifts, which are frequency specific, that recreate spatial cues that are observed in the recording when using ear-based monitors for playback. Applying these filters takes the brains' perception of the sound being placed between the listener's ears and moves it out in front of them, as if the source of the sound was coming from virtual speakers placed in front of them in a correct stereo configuration.

The graph 700 shows a resolution of 16,384 data points, resulting in an effective equalization rate of 3 hertz intervals. It is generally accepted that the human perception of changes in frequency occur at intervals of 3.6 hertz. Utilizing a filter of this size provides a level of resolution that is theoretically indistinguishable from larger filters, and will reduce the processing power and time of the processing logic 204. The use of a filter size that doubles this rate, or 32,768 data points, would reduce the filter bin size to 1.5 hertz intervals. Larger filters may be used as a matter of taste, as processing power allows.

In pre-generation of the filters to be applied to the left channel primary audio data, the left channel opposing audio data, the right channel primary audio data, and the right channel opposing audio data, white noise recordings were used to create the data for the graph shown in FIG. 7, due to the fact that it provides an output that exhibits an almost completely flat frequency response throughout the entire audible spectrum. This graph maps out the precise effects on sound as it is observed by an accurate representation of human physiology. The "X" axis is the frequency (in hertz) of the sound, and the "Y" axis shows the specific decibel (volume level) adjustment/shift that is applied at that specific frequency as a result of the physical characteristics of the binaural recording device.

When all of these data points are utilized to create an equalization filter, they are applied to each of the two source audio channels to create new primary and opposing channels, as shown in 604-607 (FIG. 6). Although the filter depicted in FIG. 7 was pre-generated using data from only a left channel recording, the same filter may be mirrored and applied to the right channel audio data. In that case, the processing logic 204 applies the filter indicated by line 701 (FIG. 7) to the right channel primary audio data and the filter indicated by line 703 (FIG. 7) to create the new right channel opposing audio data. This ensures that the effects that are being applied to each of the two channels evenly. Although this may be seen as a more technically accurate method, subjective testing has shown that using a different set of data created from a separate primary right channel recording may result in the perception of a more natural and life-like sound. The small differences that are present between the two filters seem to add a little more realism to the processed audio. Using either of these methods will still provide the desired effect, and either may be used based upon subjective taste.

Referring back to FIG. 6, once the processing logic 204 generates the left channel primary audio data (left ear), the left channel opposing audio data (right ear), the right channel opposing audio data (left ear), and the right channel primary audio data (right ear) through the afore-described filtering process, the processing logic 204 then combines the opposing channels with the primary channels to create two new primary left and right audio channels, as indicated by blocks 608 and 609. When the processing logic 204 applies the opposing channel data to each new primary channel, it is applied with a slight delay. This delay effects the perception of the localization of the sound source along the horizontal plane.

The processing logic 204 calculates the inter-aural delay by comparing the time delay that is present between when the primary (closest) ear microphone receives a specific sound as compared to when it is observed by the opposing (far) ear based microphone. This delay moves the apparent location of the sound source for each primary channel within the horizontal plane. When no delay is present, the localization, or perception of individual sounds that are unique to each respective channel are perceived to be occurring just outside of that specific ear. When a delay is applied to the newly created opposing channel information, the primary sound channel appears to move inward on the horizontal plane.

Figure 8:
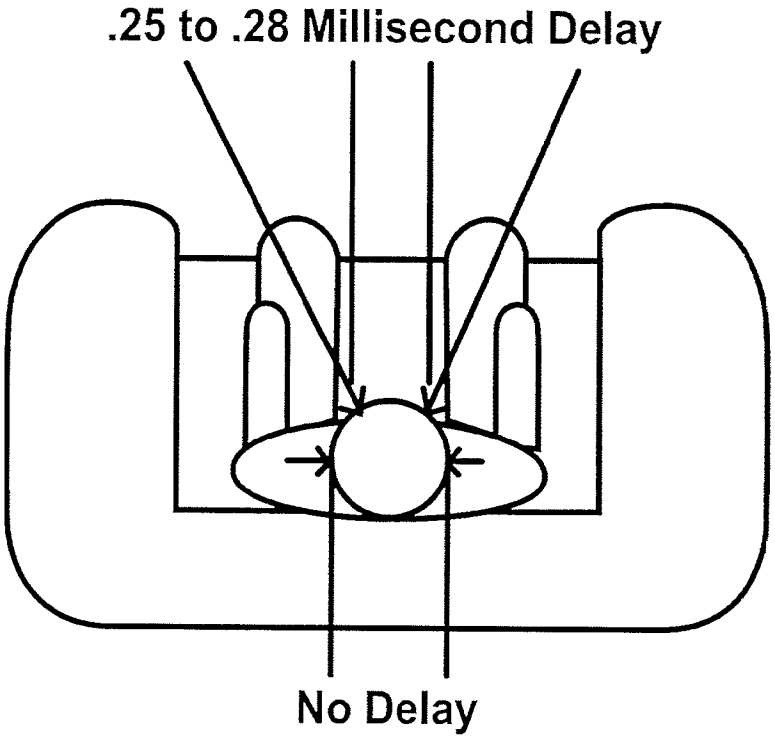
FIG. 8 is a block diagram illustrating a listening configuration and showing delays in observation of sound waves emitting from an audio source.

FIG. 8 depicts that when a recording of a sound source is analyzed in a proper stereo configuration, there is an opposing ear delay of anywhere between 0.25 and 0.28 milliseconds. When the processing logic 204 applies a delay to the filtered data for the opposing (far) ear audio data of anywhere between 0.25 to 0.28 milliseconds, the location source for each primary audio data sound is perceived to be the same as what is observed in a properly set up stereo system. In the case where this process is applied to multiple vocal inputs for a chat or conference configuration, the delays applied to each specific filtered channel are variable, based upon the precise delay that is observed at each recorded position.

Once the processing logic 204 assembles the two new channels from the filtering processing and applies the delay, the sound will exhibit a noticeable depth and spatial cues along the horizontal plane that did not exist in the original source file when being played back through ear-based monitors. Unfortunately, the tonal characteristics have been altered and the recording level has been boosted significantly throughout most of the frequency range due to the effect of the filters that have been applied. This causes two issues. Any frequencies that are boosted above the 0 Db recording level will cause what is known as clipping, which may potentially result in audible distortion during playback.

In addition to this, the overall general equalization changes that were applied by the filters have drastically changed the audible character of the original recording.

With reference to FIG. 6, to compensate for the effects, and to ensure that the processing does not alter the sound or tonal characteristics of the original recording or incoming audio stream, which is described further herein, the processing logic 204 applies an equalization filter to the resulting left channel audio data and right channel audio data and limits the peak recording level, which is indicated in blocks 610, 611, respectively, which is hereinafter referred to as "Level 1 Processing." When the processing logic 204 applies the equalization filter the result is a completely flat frequency response with the goal of remaining close to and substantially mimicking the peak recording level of the original source file. Although this equalization process returns the audio file back to the tonal characteristics of the original file, all of the spatial characteristics and delays that were applied by filtering are still present. This is because the equalization filter is bringing down and flattening the peak decibel recording level across the entire frequency range, but the adjustments applied by the processing logic 204 during the previous filtering process, and the differences between the primary and opposing audio data still exist within each respective channel. If the audio data were listened to at this point in the process with ear-based monitors, a noticeable improvement would be present in the dimensionality, perceived "soundstage" and presence over the original source file without any noticeable change to the tonal character of the music.

In one embodiment, the processing logic 204 adds a modifier to the equalization filter that features adjustments that are specific to a particular piece of playback hardware, which is hereinafter referred to as "Level 2 Processing." These adjustments are developed through analysis of accurate measurements of the frequency response curves for a specific headphone, earphone, earbud or ear based monitor. This correction may be applied simultaneously with the equalization adjustment described hereinabove. This application will refine the sound quality during playback so that it is optimized for that specific hardware device. Any newly created audio file with this modification applied for a specific hardware playback device results in a much more natural sound, and is significantly more accurate and much closer to a true "flat" frequency response than without the adjustment.

Figure 9:
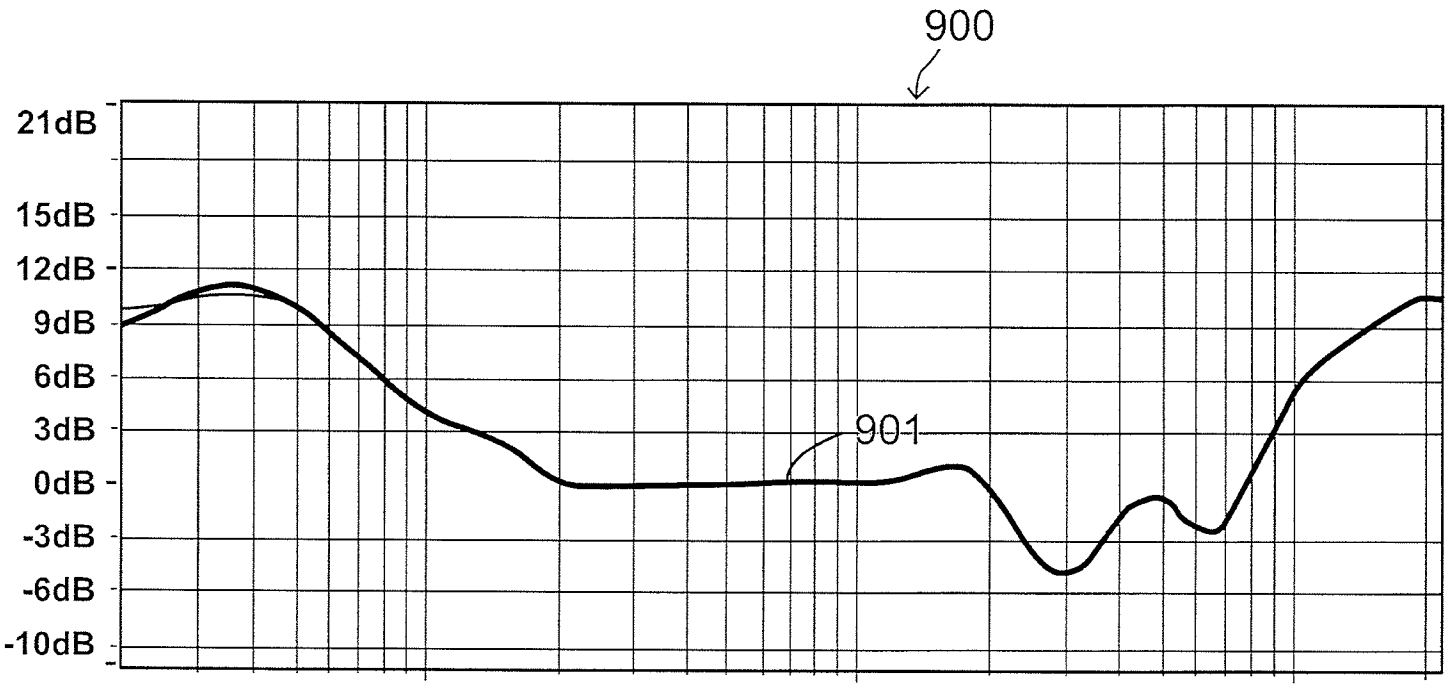
FIG. 9 is a graph depicting the frequency response of an exemplary ear-based monitor.
Figure 10:
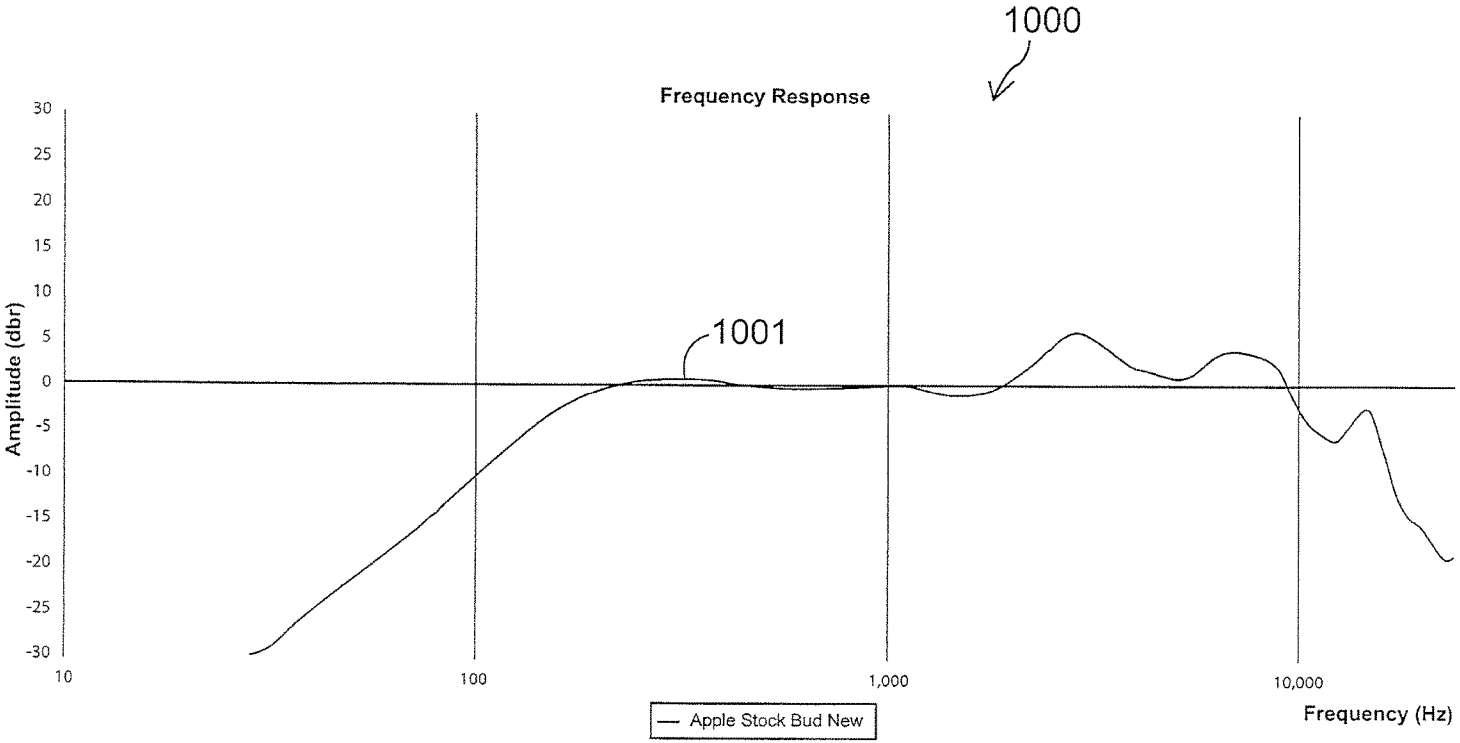
FIG. 10 is a correction profile generated for the ear-based monitor whose frequency response is depicted in FIG. 9.

FIG. 9 shows a graph 900 that illustrates a frequency response curve 901 for the common Apple original brand earbuds, which are among the most widely used of all ear based monitors. FIG. 10 shows a graph 1000 that illustrates a sample equalization correction curve 1001 generated from analysis of the frequency response curve 901. Notably, the correction curve 1001 is almost exactly the inverse of the original frequency response curve 901 (FIG. 9). By the processing logic 204 applying this equalization modifier on top of the base flat equalization described hereinabove, the processing logic 204 corrects for the low and high frequency deficiencies that exist in the drivers of this playback hardware. Although most playback hardware is relatively accurate in the midrange frequencies, this portion of the process can flatten out the midrange response, which can be especially beneficial in enhancing the quality and accuracy of the sound of vocal content. It must be noted that applying a correction that is too large among certain frequencies will increase the likelihood of clipping, which is what happens when the peak recording level goes over 0 Db.

Figure 11:
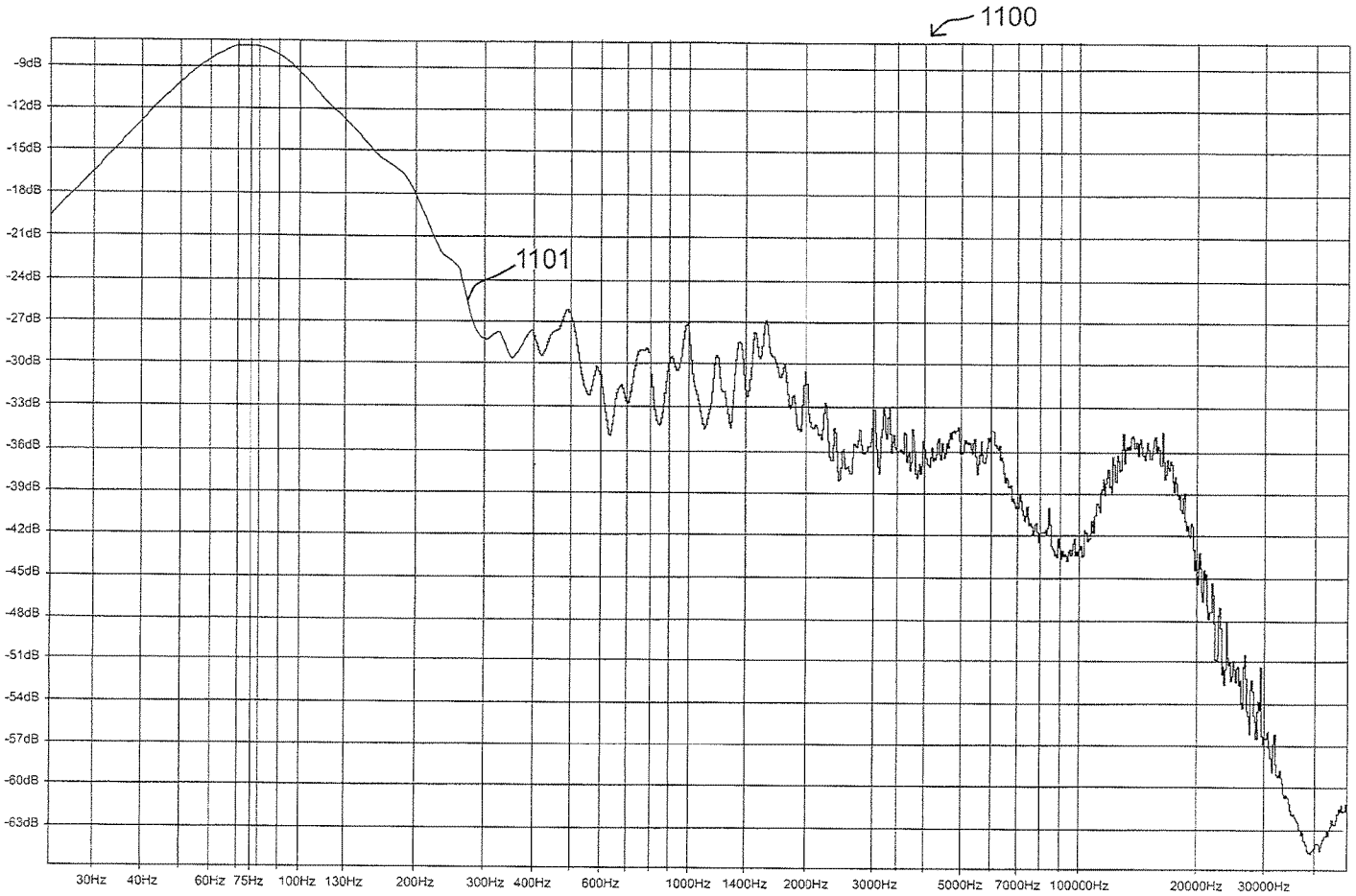
FIG. 11 is a graph of a spectral analysis of music.

In one embodiment, the audio data 210 (FIG. 5) is music. An analysis of music shows that the majority of the peak recording levels occur in the lower frequencies, and the Db recording level reduces as the frequency increases. This is illustrated clearly in FIG. 11. FIG. 11 illustrates a graph 1100 and a curve 1101 showing peak recording levels in the lower frequencies. Consequently, equalization adjustment that applies significant positive gain to the recording level in the higher frequencies is not as likely to cause clipping. However, an increase in the Db recording level in the lower frequencies, where the majority of the music energy exists as a result of the bass drum, will push the recording level above this zero Db threshold. Thus, in such an embodiment where music is the audio data 210, the processing logic 204 may ensure that the maximum recording level gain within the correction equalization is kept within a reasonable level. Additionally, the processing logic 204 also applies a final process which "normalizes" the recording level so that the audio output recording level does not "clip" or exceed the zero Db recording level, which is described further herein.

Before the processing logic 204 can apply normalization, in one embodiment, the processing logic 204 applies reverb or echo to the resulting data in the process, which increases the perception of depth that is experienced when listening to the output file. Although the process of applying each of the individual filters that were created from the test recordings (as shown in FIG. 7) do move the perception of the sound source location from between the listener's ears to be placed virtually in front of the listener, it does not take on the same depth characteristics that exist in binaural recordings during playback. Because, as described hereinabove, the processing logic 204 has isolated the effects of all external factors, leaving us only with the difference that exists between what the ears are supposed to hear with a properly set up stereo arrangement and what is normally observed through ear-based monitors.

This means that up until this point, the processing logic 204 has added nothing artificial to the original audio data 210. No effects have been added, and a spectral analysis of the Db recording level versus frequency of a "Level 1 Processing" processed audio data will look the same as the original audio data 210. The same analysis between the original file and a "Level 2 Processing" processed audio data will show that the only difference that exists is a reflection of the hardware equalization profile that was applied, which is strictly based upon the hardware equalization that was selected in the software interface.

Figure 12:
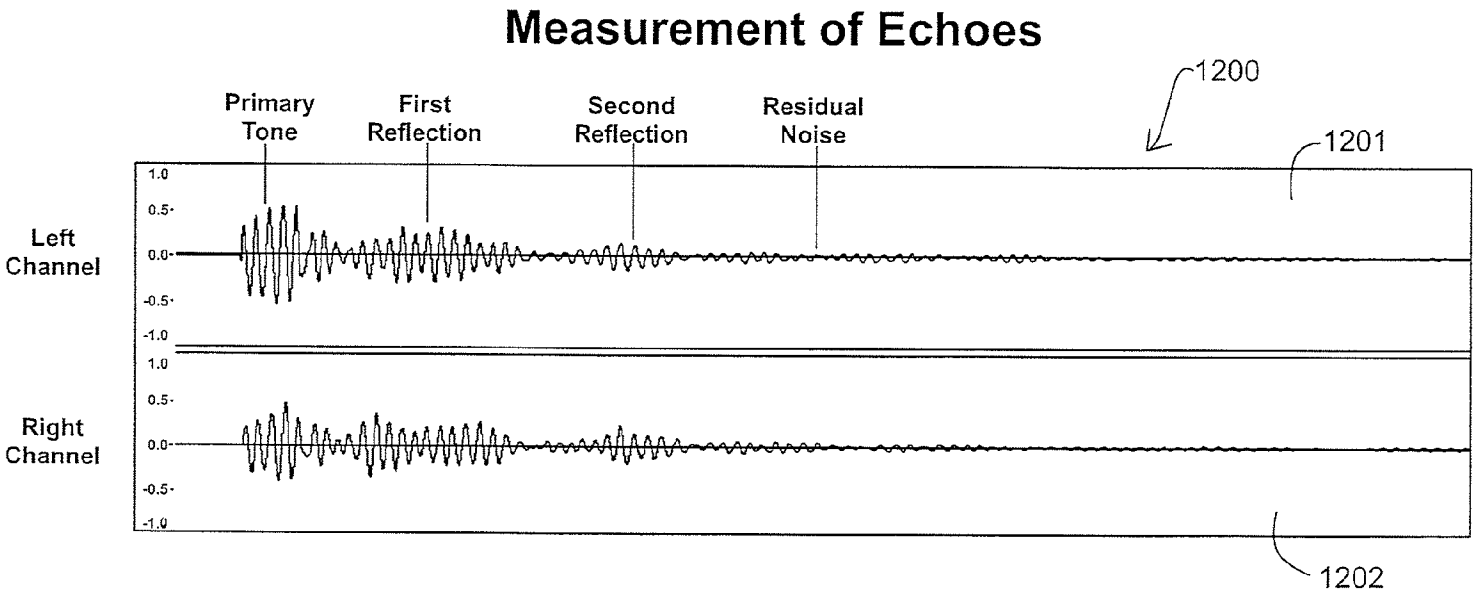
FIG. 12 is a graph illustrating measured echoes in a left audio source tone at both the primary left listening position and the opposing right listening position.

FIG. 12 is a graph 1200 showing a recording of reverb characteristics of an exemplary recording environment. The graph 1200 was generated by recording a 440 Hz chirp, with a total duration of only 10 milliseconds. Notably, the left microphone indicative of the left channel graph 1201, which is closest to the source, shows a higher decibel recording level with two clear residual decaying echoes present. The right microphone indicative of the right channel graph 1202 shows a similar response, but at a lower recording level. The initial chirp pulse is well defined in both channels, and was clearly initiated closest to the left microphone.

By using this data, a reverb profile may be generated and applied to the audio data to introduce the perception of more "depth" in the sound of the audio source. This same effect may also be modeled by the processing logic 204 by defining multiple parameters such as the shape and volume of a particular listening environment and the materials used in the construction of the walls, ceiling and floor. The introduction of this effect will alter the character of the original recording, so it is not part of the standard process. The use of this effect is left up to the personal taste of the listener, as it does deviate from the purity of the original recording. As a result of this, purists and the artists or anyone involved in the original production of the music content being processed will likely have a negative attitude towards its' implementation.

With further reference to FIG. 6, the processing logic 204 further performs normalization of the recording level exhibited in the audio data resulting from the equalization process. The processing logic 204 applies normalization to the entire audio data, post equalization, to ensure that that maximum Db recording level does not exceed the 0 Db limit.

In the normalization process, the processing logic 204 is configured to ensure that the average volume level is adequate without negatively affecting the dynamic range of the content (the difference between the loudest and softest passages). In one embodiment, the processing logic 204 analyzes the loudest peak recording level that exists within the audio data and brings that particular point down (or up) to the zero (0) Db level. Once the loudest peak recording level has been determined, the processing logic 204 re-scales the other recording levels in the audio data in relation to this new peak level.

Note that resealing maintains the dynamic range, or the difference between the loudest and softest sounds of the recording. However, the overall average recording level may end up being lower (quieter) than the original recording, particularly if large gains were applied in the Level 2 Processing when performing hardware correction, as described hereinabove. If the peak recording level goes much over the 0 Db level as a result of the equalization adjustment, it will result in significantly lower average recording level volume after normalization is applied. This is because the delta that exists between the loudest and quietest sounds present in the recording will cause the average recording level to be brought down lower than in the original file, once the peak recording level is reduced to the zero Db level and re-scaling occurs.

In another embodiment, the processing logic 204 applies a normalization scheme that maintains the existing difference between the peak and lowest recording levels and adjusts the volume to where the average level is maintained at a specified level. In such embodiment, if a large amount of "Level 2 Processing" hardware correction was applied, clipping above the 0 Db level is likely. This is particularly likely at frequency points where the playback device is deficient and the original recording happened to be strong at that particular frequency. In one embodiment, the processing logic 204 implements a limiter that does not allow any of the peak spikes in the recording to exceed the peak 0 Db level. In this regard, the processing logic 204 effectively clamps the spikes and keeps them from exceeding the 0 Db level. In one embodiment, the processing logic 204 effectively clamps the spikes, as described, and also employs in conjunction "Level 2 Processing." The Level 2 Processing does not apply too much gain in frequency ranges that tend to approach the 0 Db level before equalization, as described hereinabove. Employing both processes maintains an adequate average recording level volume in the audio data.

In the case of voice chat processing, the processing logic 204 may not apply normalization. Notably, unlike a specific audio recording, the processing logic 204 may be unable to analyze a finite portion of the audio stream to determine the peak recording level due to the nature of the audio data, i.e., it is streaming data. Instead, the processing logic 204 may employ a different type of audio data normalization in real time to ensure that the volume level of each of the voice input channels is relatively the same in comparison with the others. If real time audio data normalization is not employed, the volume level of certain particular voices may stand out or be more than others, based upon the sensitivity of their microphone, relative distance between the microphone and the sound source or the microphone sensitivity settings on their particular hardware. To address this scenario, the processing logic 204 maintains an average volume level of normalization that is within a specific peak level range. Making this range too narrow will result in over boosting quiet voices, so in one embodiment, the processing logic 204 allows for a certain amount of dynamic range while still keeping the vocal streams at a level that is audible.

With further reference to FIG. 6, once the processing logic 204 has normalized the audio data, the processing logic 204 generates an output file for transmitting to the listener 101 (FIG. 1) as identified in blocks 614 and 615. In this regard, if the audio data 210 that is being processed is an audio file, the processing logic 204 saves the audio data as processed audio data 211 (FIG. 5). If the audio data 210 is streamed, for example for a voice chat scenario, the audio data will be streamed through other logic. When the audio data 210 was originally an audio file, the processing logic 204 will automatically save the audio data as in a WAV format file of the same bit rate and sampling frequency as the audio data 210 that is input into the processing logic 204 or expanded compressed format file. In one embodiment, the processing logic 204 may re-encode the WAV file created into another different available compressed format as indicated in block 615.

In one embodiment, the user may have a license to other different compression formats. In such an embodiment, the processing logic 204 may re-encode with any of these specific compression schemes based upon licenses, personal preference of the user, and/or who is distributing the processing logic 204.

Figure 13:
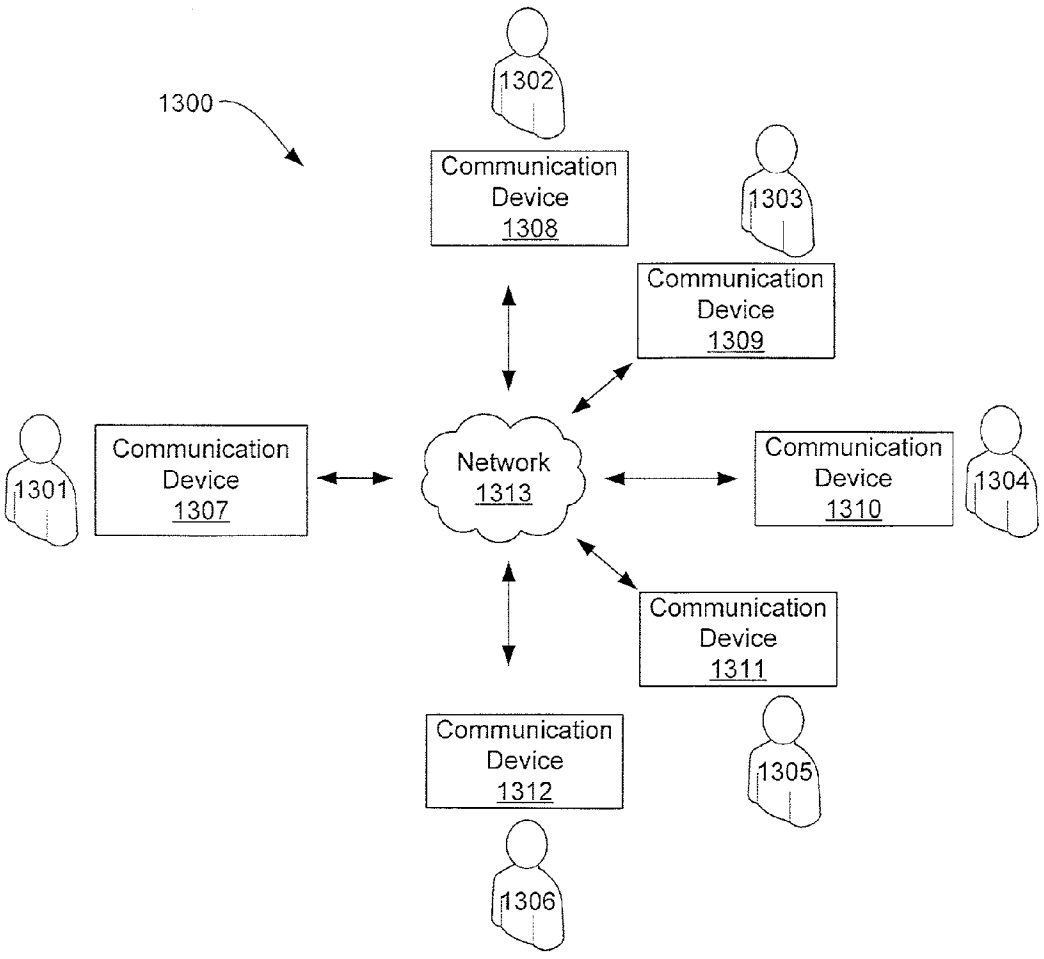
FIG. 13 is another exemplary audio processing system in accordance with an embodiment of the present disclosure.

FIG. 13 depicts another embodiment of an audio processing system 1300 in accordance with an embodiment of the present disclosure. The system 1300 comprises a plurality of communication devices 1307-1312 operated by a plurality of user's 1301-1306, respectively. The communication devices 1307-1312 receive and transmit data over a network 1313, e.g., a public switched telephone network (PSTN), a cellular network, a wired Internet, and/or a wireless Internet.

In operation, one of the user's, e.g., user 1301, initiates a teleconference via the communication device 1307. Thereafter, each of the other users 1308-1312 joins the telephone conference through their respective communication devices 1307-1312.

In one embodiment, the communication devices 1307-1312 are telephones. However, other communication devices are possible in other embodiments. For example, the communication devices 1307-1312 may be mobile phones that communicate over the network, e.g., a cellular network, tablets (e.g., iPads™) that communicate over the network, e.g., a cellular network, laptop computers, desktop computers, or any other device on which the users 1301-1306 could participate in a teleconference.

In the system 1300 depicted, the communication device 1307 comprises logic that receives streamed voice data signals (not shown) over the network 1313 from each of the other communication devices 1308-1312. Upon receipt, the communication device 1307 processes the received signals such that user 1301 can clearly understand the incoming voice signals of the multiple users 1308-1312, simultaneously, which is described further herein.

In the embodiment, the communication device 1307 receives streamed voice data signals, which are monaural voice data signals, and the communication device 1307 processes each individually using a specific filter with an applied delay to create a two channel stereo output. The multiple monaural voice data signals received are converted to stereo localized signals. The communication device 1307 combines the multiple signals to create a stereo signal that will allow user 1307 to easily distinguish individual voices during the teleconference.

Note that the other communication devices 1308-1312 may also be configured similarly to communication device 1307. However, for simplicity of description, the following discussion describes the communication device 1307 and its use by the user 1301 to listen to the teleconference.

Figure 14:
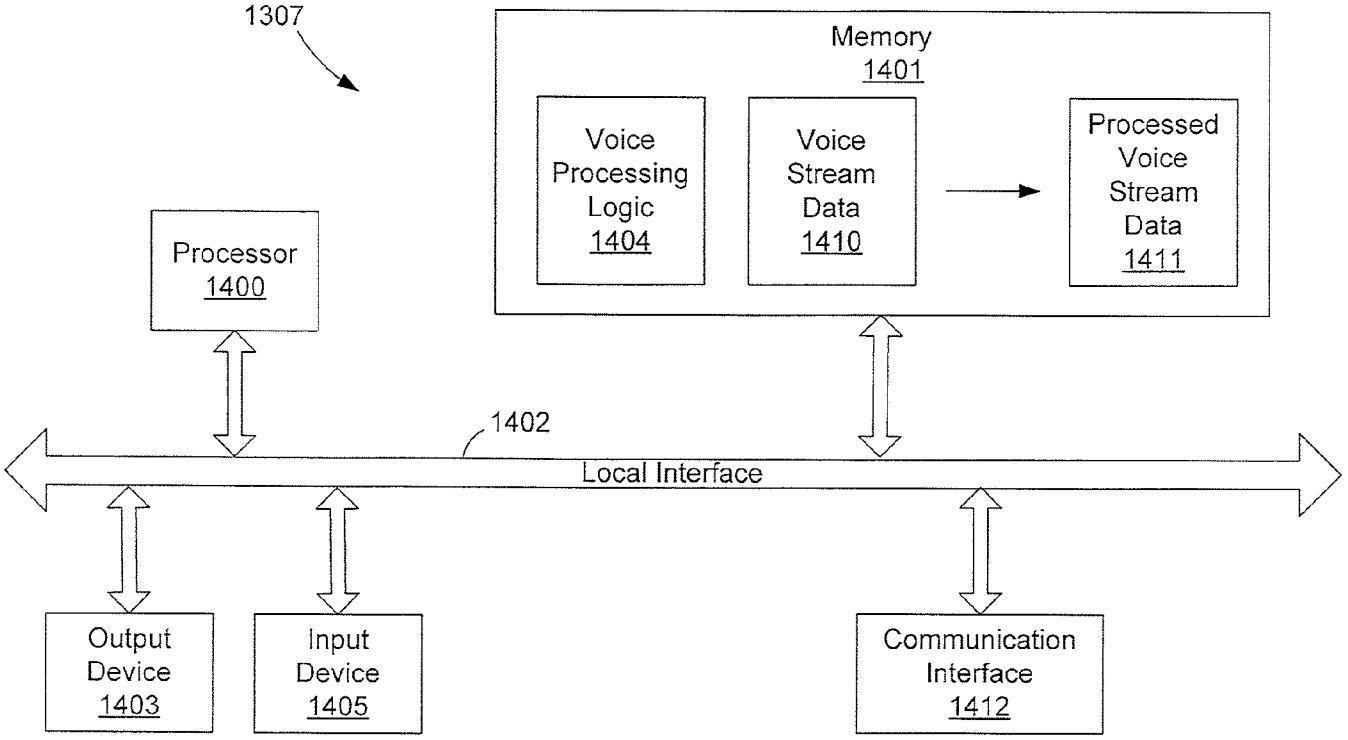
FIG. 14 is a block diagram of an exemplary communication device depicted in FIG. 13.

FIG. 14 depicts an exemplary embodiment of the communication device 1307 of FIG. 13. The device 1307 comprises at least one conventional processing element 1400, such as a central processing unit (CPU) or digital signal processor (DSP), which communicates to and drives the other elements within the device 1307 via a local interface 1402.

The communication device 1307 further comprises voice processing logic 1404 stored in memory 1401. Note that memory 1401 may be random access memory (RAM), read-only memory (ROM), flash memory, and/or any other types of volatile and nonvolatile computer memory.

Note that the voice processing logic 1404 may be software, hardware, or any combination thereof. When implemented in software, the processing logic 1404 can be stored and transported on any computer-readable medium for use by or in connection with an instruction execution apparatus that can fetch and execute instructions. In the context of this document, a "computer-readable medium" can be any means that can contain or store a computer program for use by or in connection with an instruction execution apparatus.

The communication device 1307 further comprises an output device 1403, which may be, for example, a speaker or a light emitting diode (LED) display. The output device 1403 is any type of device that provides information to the user as an output.

The communication device 1307 further comprises an input device 1405. The input device 1405 may be, for example, a microphone or a keyboard. The input device 1405 is any type of device that receives data from the user as input.

The voice processing logic 1404 is configured to receive multiple voice data streams from the plurality of communication devices 1308-1312. Upon receipt, data indicative of the voice data streams may be stored as voice stream data 1410. Note that streaming in itself means that the data is not stored in non-volatile memory, but rather in volatile memory, such as, for example, cache memory. In this regard, the streaming of the voice data 1410 uses little storage capability.

Figure 16:
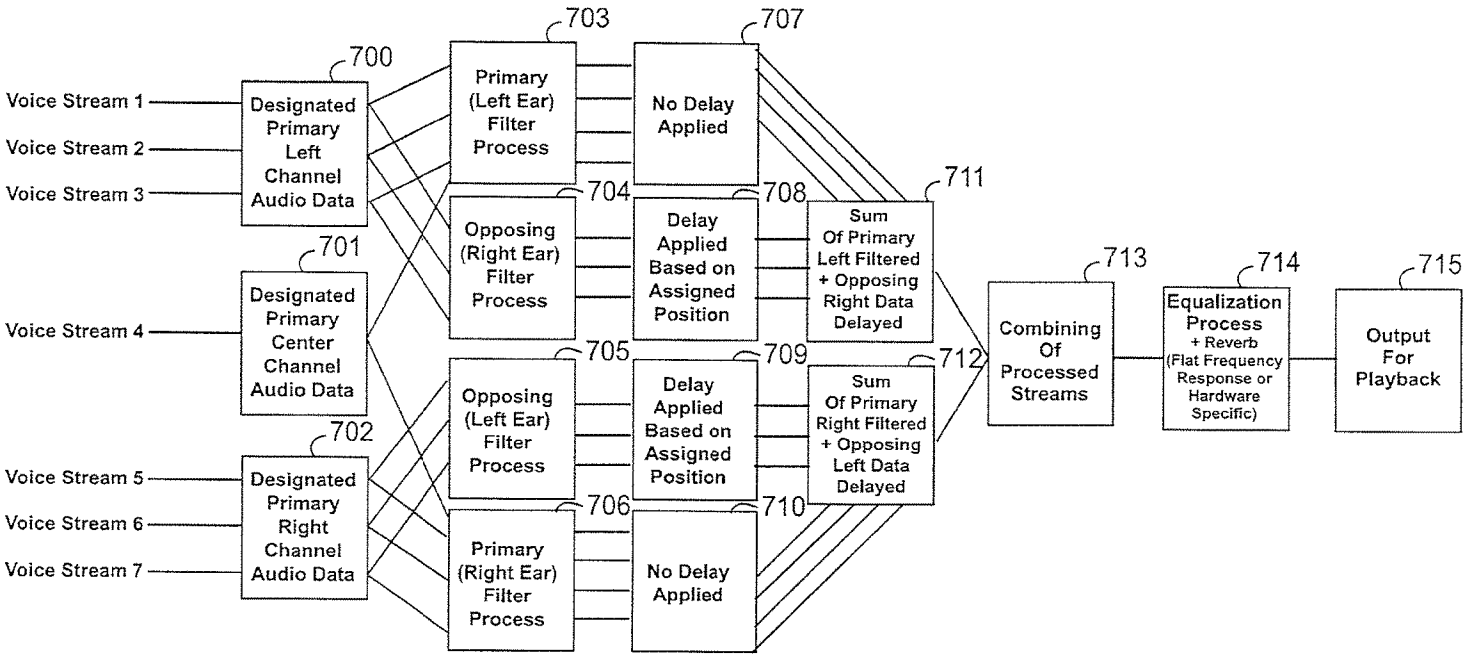
FIG. 16 is a flowchart illustrating exemplary architecture and functionality of exemplary processing logic for a seven-person chat or teleconference scenario.

Note that there are three channels represented in FIG. 16. FIG. 16 depicts a left channel, represented by box 700, a center channel, represented by box 701, and a right channel, represented by box 702.

Upon receipt of the voice stream data 1401, the voice processing logic 1404 assigns a virtual position to each instance of voice stream data 1410. The particular channel that is selected by the processing logic 1404 to process the voice stream data 1410 is based upon the position the voice processing logic 1404 assigns to the each instance of voice stream data 1410 receive, which is described further with reference to FIG. 15. The voice processing logic 1404 then process the voice stream data 1410 to output processed voice stream data 1411. This process is further described with reference to FIG. 16.

Figure 15:
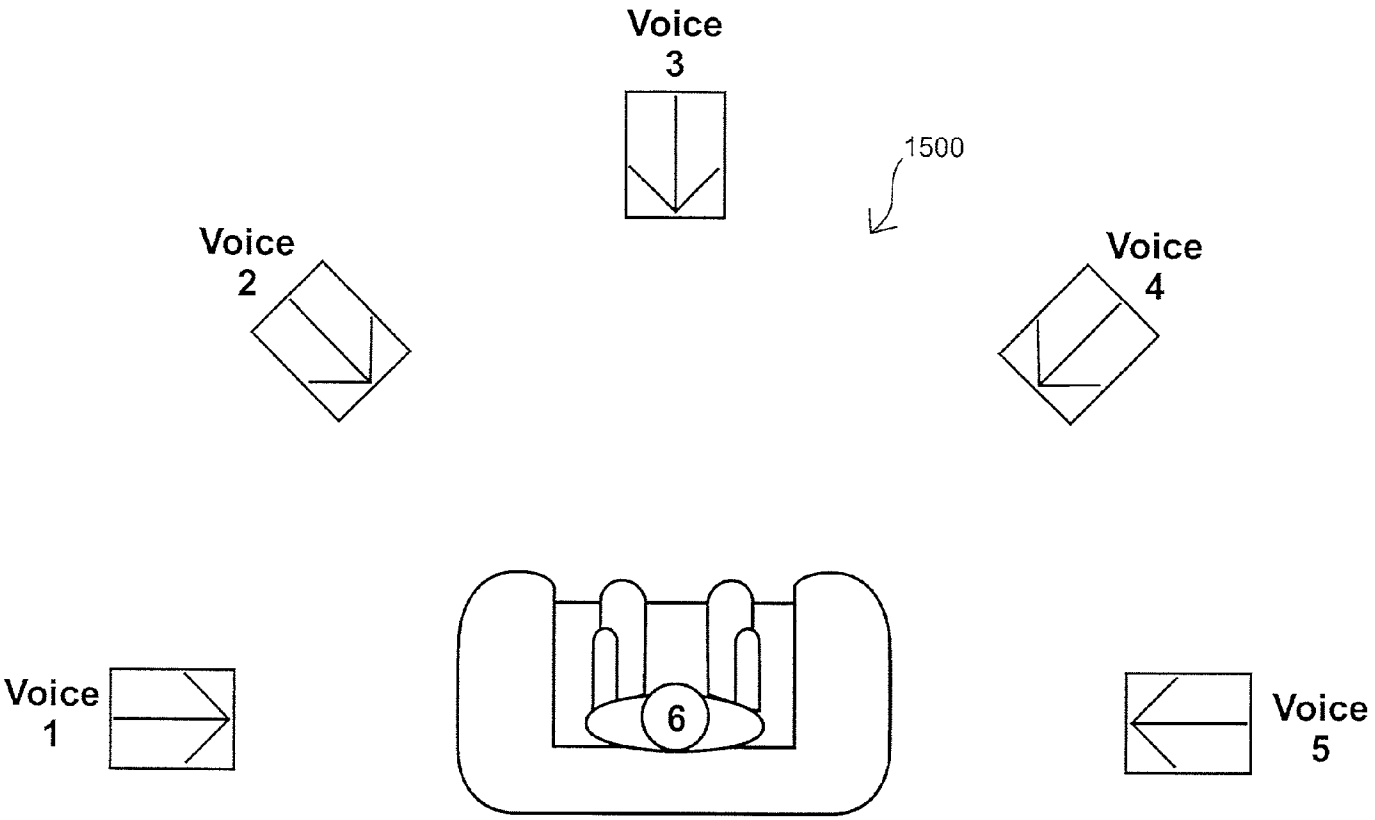

FIG. 15 depicts a configuration 1500 of an individual 6 having a conversation with multiple parties. Each party is indicated by "Voice 1," "Voice 2," "Voice 3," "Voice 4," and "Voice 5." The configuration 1500 diagrams the perceived virtual position for each participant in more efficient variation of voice chat or conference.

Note that in the embodiment depicted it would be possible to have six distinct voices in configuration 1500 by individually processing (on the receiving end) and placing the sixth voice in the same virtual position that each individual has been previously assigned to. For example, the first person in the conversation would hear the final (6th) voice in the position directly in front of them, which is the only "empty" spot that is available to them, since they will not be hearing their own voice in this position. The same would hold true for each of the other participants, as their "empty" spot that they were assigned to would then be filled by the last participant to join the chat session. In order to accomplish this, once the last position has been filled, the "final" voice data stream would need to be broadcast in its original monaural format, so that it may be processed separately in the appropriate slot for each of the other individuals in the conversation. This means that in addition to processing each individual's outgoing voice data stream, each individual's hardware would also need to apply the specific filter to the last participant's incoming monaural voice data stream, so that it may be placed in their particular "empty" spot, which is the location that all of the others will hear their voice located. Although this does allow for one additional participant, it does double the processing required for each individual's hardware, should the final position be filled by a participant.

In another embodiment, the processing logic 1404 may add more virtual positions and accept that the position each person has been assigned to will appear to be "empty" to them. By placing each virtual participant at 30 degree intervals, the number of potential individuals participating in the chat increases to 7, without the need to add the additional processing to fill each of the "empty" spaces assigned to each individual. Going to a spacing of 22.5 degrees will allow for as many as 9 individuals to chat simultaneously with the same process. Increasing the number beyond this level would likely result in making it more difficult for each of the individual users to clearly distinguish among each of the participants.

FIG. 16 depicts exemplary architecture and functionality of the voice processing logic 1404 of FIG. 14. The architecture and functionality of the voice processing logic 1404 is similar to the architecture and functionality of the audio processing logic 204 (FIG. 2). Where similarities exist in the present description of voice processing logic 1404, reference will be made to the description hereinabove with reference to FIG. 6.

Initially, the voice processing logic 1404 receives a plurality of instances of voice stream data 1410 (FIG. 14). Upon receipt, the voice processing logic 1404 assigns a position to each instance of the voice stream data 1410. In this regard, the voice processing logic 1404 assigns a left position to voice stream data instances 1, 2, and 3. The processing logic 1404 also assigns a center position to voice stream data instance 4 and assigns a right position to voice stream data instances 5, 6, and 7. In this regard, instances 1, 2, and 3 are designated as primary left channel voice data, instance 4 is designated as primary center channel voice data, and instances 5, 6, and 7 are designated as primary right channel voice data in blocks 700-702, respectively.

Notably, in making the assignments, the processing logic 1404 designates that the instances of voice stream data in the left channel are virtually positioned to the left of a listener. In the example provided in FIG. 15, those positions to the left of listener 6 would be "Voice 1" and "Voice 2." Further, the processing logic designates that the instance of voice stream data in the center channel are virtually positioned aligned in front of the listener, e.g., "Voice 3" in FIG. 15. The processing logic 1404 also designates that the instances of voice stream data in the right channel are virtually positioned to the right of the listener. In the example provided in FIG. 15, those positions to the right listener 6 would be "Voice 4" and "Voice 5." The processing logic 1404 then processes each channel accordingly.

Note that when the processing logic 1404 assigns positions to an instance of voice stream data, the processing logic 1404 is designating to which channel the instance is assigned for processing. With reference to FIG. 16, the processing logic 1404 designates voice stream data 1, 2, and 3 to the left channel, voice stream data 4 to the center channel, and voice stream data 5, 6, and 7 to the right channel.

Once the processing logic 1404 assigns positions to each instance of voice stream data 1410, the processing logic separates each instance of voice stream data in each channel into primary and opposing voice stream data. In this regard, the processing logic 1404 separates each instance of voice stream data in the left channel into primary left ear voice stream data and opposing right ear voice stream data. As indicated hereinabove, the left channel processes voice stream data designated to the left of the listener. The processing logic 1404 separates the instance of voice stream data in the center channel into primary left ear voice stream data and primary right ear voice stream data. Further, the processing logic 1404 separates each instance of voice stream data in the right channel into primary right voice stream data and opposing left voice stream data.

The voice processing logic 1404 processes the left channel voice stream data, the center channel voice stream data, and the right channel voice stream data through multiple separate filters to create both primary voice stream data and opposing voice stream data for each of the left, center, and right channels. The data indicative of the primary and opposing audio data for each of the left channel voice stream data, the center channel voice stream data, and right channel voice stream data are filtered, as indicated by blocks 703-706.

Each of these filters applied by the processing logic 1404 is pre-generated based upon a similar configuration as depicted in FIG. 15. The process of creating the pre-generated filters is discussed more fully hereinabove.

Once the processing logic 1404 filters the instances of voice stream data, the processing logic 1404 applies a delay to the opposing right ear voice stream data, as indicated in block 708, and the opposing left ear data, as indicated in block 709. Note that the processing logic 1404 does not apply a delay to the primary left ear voice stream data and the primary right ear voice stream data for the center channel.

Once the processing logic 1404 applies delays, the processing logic 1404 sums the primary left ear voice stream data and the delayed opposing right ear voice stream data from the left channel, as indicated in block 711. Further, the processing logic 1404 sums the primary right ear voice stream data and the delayed opposing left ear voice stream data from the right channel, as indicated in block 712. In block 713, the processing logic 1404 combines each sum corresponding to each instance of voice stream data in to a single instance of voice stream data. Once combined, the processing logic 1404 may apply equalization and reverb processing, as described with reference to FIG. 6, to the single instance of voice stream data, as indicated in block 714. The processing logic 1404 outputs the processed voice stream data 1411 for playback to listener, as indicated in block 715.

In another embodiment, the each communication device 1307-1312 comprises voice processing logic 1404. In such an embodiment, the processing logic 1404 assigns each instance of voice stream data 1410 a specific position within the virtual chat environment, and the appropriate filtering, delay and environmental effects are applied at each communication device 1307-1312, prior to transmission to the other participants. In such an embodiment, only the one (outgoing) voice data stream is processed at each of the participant's location, and all of the incoming (stereo) vocal data streams are simply combined together at each destination. Such an embodiment may reduce the processing overhead required for each individual participant, as their hardware is only responsible for filtering their outgoing voice signal. However, in such an embodiment, the number of potential participants is reduced, as compared to the method utilized in FIG. 16.

Figure 17:
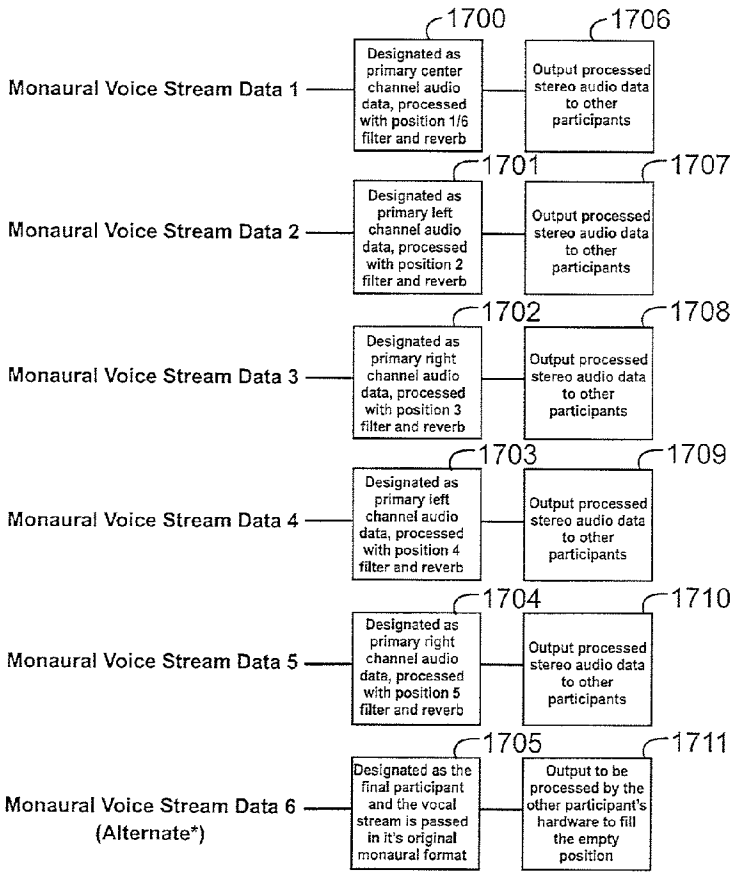
FIG. 17 is another flowchart illustrating exemplary architecture and functionality of exemplary processing logic as depicted in FIG. 15.

FIG. 17 is a block diagram depicting an embodiment of the present disclosure wherein the processing logic 1404 resides on each of the communication devices 1307-1312. Note that each block 1700-1705 is identical and represent the processing that occurs on each respective communication device 1307-1312.

In this regard, each instance of the processing logic 1404 receives a monaural voice stream data 1 through 6. The processing logic 1404 at each communication device 1307-1312 processes the voice stream data 1-6, respectively. Notably, in block 1700, the processing logic 1404 receives the voice stream data 1 and designates the voice stream data 1 as the center channel, applies the filter and reverb, and outputs the processed voice stream data, as indicated in block 1706. In block 1701 the processing logic 1404 receives the voice stream data 2 and designates the voice stream data 2 as the primary left channel, applies the filter and reverb, and outputs the processed voice stream data to the other participants, as indicated in block 1707. In block 1702 the processing logic 1404 receives the voice stream data 3 and designates the voice stream data 3 as the primary right channel, applies the filter and reverb, and outputs the processed voice stream to the other participants, as indicated in block 1708. In block 1703 the processing logic 1404 receives the voice stream data 4 and designates the voice stream data 4 as the primary left channel, applies the filter and reverb, and outputs the processed voice stream data to the other participants, as indicated in block 1709. In block 1704 the processing logic 1404 receives the voice stream data 5 and designates the voice stream data 5 as the primary right channel, applies the filter and reverb, and outputs the processed voice stream data to the other participants, as indicated in block 1710. In block 1705 the processing logic 1404 receives the voice stream data 6 and designates the voice stream data 6 as the final participant, and the voice stream data is outputted in its original monaural form, as indicated by block 1711.

Each communication device 1307-1312 receives each of the other output processed voice data stream. Upon receipt, each communication device 1307-1312 combines all the instances of voice data streams received and plays the combined data for each respective user.

What is claimed is:

1. A system for processing audio data, the system comprising:

an audio processing device for receiving audio data from an audio source; and logic configured for separating the audio data received into left channel audio data indicative of sound from a left audio source and right channel audio data indicative of sound from a right audio source, the logic further configured for separating the left channel audio data into primary left ear audio data and opposing right ear audio data and for separating the right channel audio data into primary right ear audio data and opposing left ear audio data, the logic further configured for applying a first filter to the primary left ear audio data, a second filer to the opposing right ear audio data, a third filter to the opposing left ear audio data, and a fourth filter to the primary right ear audio data, wherein the second and third filters introduce a delay into the opposing right ear audio data and the opposing left ear audio data, respectively, the logic further configured for summing the filtered primary left ear audio data with the filtered opposing left ear audio data to obtain processed left channel audio data and for summing the filtered primary right ear audio data with the filtered opposing right ear audio data to obtain processed right channel audio data, the logic further configured for combining the processed left channel audio data and the processed right channel audio data into processed audio data and outputting the processed audio data to a listening device for playback by a listener.

2. The system of claim 1, wherein the audio processing device is communicatively coupled to an audio data source and the audio processing device receives the audio from the audio data source.

3. The system of claim 1, wherein the processed audio data is transmitted via a network to the listening device for playback by the listener.

4. The system of claim 1, wherein the audio data is moving picture experts group layer-3 (MP3) data, Windows wave (WAV) data, or streamed data.

5. The system of claim 1, wherein the first, second, third, and fourth filters are generated by:

(a) creating a free field baseline recording of an original source material using particular playback hardware, recording devices, and microphones;

(b) creating a set of recordings using omnidirectional microphones coupled to a dummy head system in a particular environment, wherein the recordings exhibit characteristics having directional cues and frequency recording level shifts that mimic the directional cues and frequency recording level shifts observed by a human in the same environment; and (b) comparing the free field baseline recording of the original source with the set of recordings using the omnidirectional microphones.

6. The system of claim 1, wherein the logic is further configured to apply equalization to the left channel audio data and the right channel audio data that limits the peak recording level so that the frequency response substantially mimics the peak recording level of original source data.

7. The system of claim 1, wherein the logic is further configured to apply equalization to the left channel audio data and the right channel audio data that introduces adjustments corresponding to a particular piece of hardware.

8. The system of claim 7, wherein the hardware is headphones, earphones, or earbuds.

9. The system of claim 1, wherein the logic is further configured for normalizing the left channel audio data and the right channel audio data by analyzing the loudest peak recording level that exists in the left channel audio data and the right channel audio data and modifying the loudest peak to the zero (0) decibel (Db) peak recording level.

10. The system of claim 9, wherein the logic is further configured for bringing a recording level of the loudest peak down to zero (0) Db peak recording level.

11. The system of claim 9, wherein the logic is further configured for bringing a recording level up to zero (0) Db peak recording level.

12. The system of claim 9, wherein the logic is further configured for re-scaling a plurality of other recording levels in relation to the peak recording level.

13. The system of claim 1, wherein the logic is further configured for normalizing the left channel audio data and the right channel audio data by adjusting a volume of each of the left channel audio data and the right channel audio data to the average level maintained.

14. The system of claim 1, wherein the logic is further configured for normalizing the left channel audio data and the right channel audio data by limiting one or more peak spikes in the left channel audio data and the right channel audio data.

15. The system of claim 14, wherein the logic is further configured for limiting the one or more peak spikes to zero (0) Db peak recording level.

16. The system of claim 1, wherein the audio data is voice stream data.

17. The system of claim 16, wherein the logic is further configured for associating the voice stream data to one of the primary left channel, the center channel, or the right channel.

18. A system for processing audio data, the system comprising:

an audio processing device for receiving a plurality of instances of audio data indicative of a plurality of voice streams from an audio source; and logic configured for assigning a position to each instance of audio data and separating the audio data received into left channel audio data indicative of sound from a left audio source, center channel audio data indicative of a center audio source, and right channel audio data indicative of sound from a right audio source, the logic further configured for separating the left channel audio data into primary left ear audio data and opposing right ear audio data, for separating the center channel audio data into the primary left ear audio data and primary right ear audio data, and for separating the right channel audio data into the primary right ear audio data and opposing left ear audio data, the logic further configured for applying a first filter to the opposing right ear audio data and a second filter to the opposing left ear, wherein the first and second filters introduce a delay into the opposing right ear audio data and the opposing left ear audio data, respectively, the logic further configured for summing the primary left ear audio data with the filtered opposing left ear audio data into processed left channel audio data into left channel audio data and for summing the filtered primary right ear audio data with the filtered opposing right ear audio data into processed right channel audio data into right channel audio data, the logic further configured for combining the processed left channel audio data and the processed right channel audio data into processed audio data and outputting the processed audio data to a listening device for playback by a listener.

* * * * *